US011794079B2

(12) United States Patent
Hare et al.

(10) Patent No.: US 11,794,079 B2
(45) Date of Patent: Oct. 24, 2023

(54) AMERICAN-STYLE FOOTBALL HAVING A REDUCED MOI

(71) Applicant: Wilson Sporting Goods Co., Chicago, IL (US)

(72) Inventors: Daniel E. Hare, Elgin, IL (US); Kevin L. Krysiak, Palatine, IL (US); Andrew K. Tryner, Chicago, IL (US); Daniel W. Kolcun, Chicago, IL (US); Andrew J. Wentling, Carey, OH (US); Robert T. Thurman, Glenn Ellyn, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 17/359,888

(22) Filed: Jun. 28, 2021

(65) Prior Publication Data

US 2021/0322834 A1 Oct. 21, 2021

Related U.S. Application Data

(63) Continuation of application No. 16/362,311, filed on Mar. 22, 2019, now Pat. No. 11,058,923.

(51) Int. Cl.

| | |
|---|---|
| ***A63B 43/00*** | (2006.01) |
| ***A63B 41/02*** | (2006.01) |
| ***A63B 41/08*** | (2006.01) |

(52) U.S. Cl.

CPC ..... *A63B 43/00* (2013.01); *A63B 41/02* (2013.01); *A63B 41/085* (2013.01); *A63B 2209/00* (2013.01); *A63B 2243/007* (2013.01)

(58) Field of Classification Search

CPC ..... A63B 43/00; A63B 41/02; A63B 41/085; A63B 2209/00; A63B 43/04; A63B 2243/007

See application file for complete search history.

(56) References Cited

U.S. PATENT DOCUMENTS

| | | | | | |
|---|---|---|---|---|---|
| 1,002,928 | A | | 9/1911 | Pierce | |
| 1,559,364 | A | | 4/1923 | Pearce | |
| 1,621,898 | A | | 3/1927 | Pierce | |
| 2,182,053 | A | * | 12/1939 | Reach | A63B 41/08 473/597 |
| 2,219,078 | A | * | 10/1940 | Reach | A63B 39/06 473/607 |
| 2,364,247 | A | * | 12/1944 | Shearer | F16K 15/202 473/610 |
| 2,524,546 | A | * | 10/1950 | Sinclaire | A63H 33/26 273/108 |
| 2,653,818 | A | * | 9/1953 | Tebbetts, Jr. | A63B 39/00 428/161 |
| 2,874,965 | A | | 2/1959 | Martin | |
| 3,887,416 | A | * | 6/1975 | Tebbetts, Jr. | A63B 41/00 156/172 |
| 4,003,574 | A | | 1/1977 | MacDonald | |

(Continued)

*Primary Examiner* — Steven B Wong

(74) *Attorney, Agent, or Firm* — Terence P. O'Brien; Todd A. Rathe

(57) ABSTRACT

An American-style football may include a prolate spheroidal shaped bladder having a longitudinal axis, an outermost layer about the bladder, a lacing surface featuring a series of parallel projections from an exterior of the outermost layer and an intermediate sandwiched between the bladder and the outermost layer, wherein the intermediate layer is configured to decrease a MOI of the football.

16 Claims, 12 Drawing Sheets

(56) References Cited

U.S. PATENT DOCUMENTS 4,660,831 A 4/1987 Kralik
4,998,728 A * 3/1991 Traub ..... A63B 41/00 273/DIG. 20
5,000,451 A * 3/1991 MacDonald ..... A63B 43/00 273/DIG. 20
5,096,756 A 3/1992 Walters
5,098,097 A * 3/1992 Kennedy ..... A63B 41/00 473/599
5,123,645 A 6/1992 MacDonald
5,224,704 A * 7/1993 Snell ..... A63B 41/00 273/DIG. 20
RE34,383 E 9/1993 Rohring
5,261,661 A * 11/1993 Lemmon ..... A63B 41/00 273/DIG. 20
5,316,293 A 5/1994 Hamilton
5,342,043 A * 8/1994 Baltronis ..... A63B 41/00 473/599
5,480,144 A * 1/1996 Downing ..... A63B 41/085 473/603
5,676,611 A 10/1997 Foster
5,888,157 A * 3/1999 Guenther ..... A63B 41/08 473/604
6,629,902 B2 10/2003 Murphy et al.
6,761,654 B2 7/2004 Murphy et al.
6,767,300 B2 7/2004 Murphy et al.
6,964,625 B2 11/2005 Murphy et al.
7,029,407 B2 4/2006 Lee et al.
7,273,431 B2 9/2007 DeVall
7,867,116 B2 1/2011 Guenther et al.
8,047,937 B2 11/2011 Krysiak
8,128,523 B2 3/2012 Laliberty et al.
8,142,311 B2 3/2012 Krysiak
8,366,574 B2 2/2013 Guenther et al.
8,449,417 B2 5/2013 Bevier et al.
8,460,135 B2 6/2013 Guenther et al.
8,512,177 B2 * 8/2013 Krysiak ..... A63B 43/004 473/570
8,579,742 B2 11/2013 Krysiak
8,870,689 B2 10/2014 Krysiak et al.
8,870,690 B2 10/2014 Krysiak et al.
8,905,876 B2 12/2014 Guenther et al.
8,926,458 B1 1/2015 Wood
9,017,192 B1 * 4/2015 Silva ..... A63B 69/002 473/604
9,259,624 B2 2/2016 Frank et al.
9,452,322 B2 9/2016 Thurman et al.
9,511,266 B2 12/2016 Swiszcz
9,586,098 B1 3/2017 Ahsan
9,636,550 B2 5/2017 Thurman et al.
9,776,047 B2 10/2017 Krysiak et al.
10,029,155 B1 * 7/2018 Lo ..... A63B 41/02
10,159,884 B2 12/2018 Thurman et al.
10,220,264 B2 3/2019 Krysiak et al.
10,238,922 B2 3/2019 Krysiak et al.
10,398,945 B2 9/2019 Thurman et al.
10,463,921 B2 11/2019 Krysiak et al.
10,525,311 B2 1/2020 Kolcun et al.
11,058,923 B2 * 7/2021 Hare ..... A63B 43/00
11,110,323 B2 * 9/2021 Conen ..... A63B 43/002
2003/0069097 A1 4/2003 Guenther
2003/0228946 A1 12/2003 Chan
2005/0288133 A1 12/2005 Rudell
2006/0205547 A1 9/2006 O'Neill et al.
2009/0137352 A1 5/2009 Ou
2009/0286632 A1 11/2009 Laliberty
2010/0130314 A1 * 5/2010 Von Der Gruen ..... A63B 63/00 473/603
2011/0015010 A1 * 1/2011 Forrest, Sr. ..... A63B 41/00 473/594
2011/0183791 A1 7/2011 Lo
2013/0035182 A1 2/2013 Sing
2014/0100067 A1 4/2014 Swiszcz
2014/0256478 A1 9/2014 Gale
2015/0031482 A1 1/2015 Frank et al.
2016/0346626 A1 12/2016 Nurnberg
2016/0346627 A1 12/2016 Le
2017/0291076 A1 10/2017 Campbell
2018/0161635 A1 6/2018 Ahmed
2018/0318655 A1 11/2018 Krysiak et al.
2019/0160345 A1 5/2019 Feng
2019/0160346 A1 5/2019 Feng

* cited by examiner

AMERICAN-STYLE FOOTBALL HAVING A REDUCED MOI

CROSS-REFERENCE TO RELATED PATENT APPLICATIONS

The present continuation application claims priority under 35 U.S.C. § 120 from co-pending U.S. patent application Ser. No. 16/362,311 filed on Mar. 22, 2019, by Hare et al. and entitled AMERICAN-STYLE FOOTBALL HAVING A REDUCED MOI, the full disclosure of which is hereby incorporated by reference.

BACKGROUND

Amongst the various balls utilized in sports today, American-style footballs have a largely unique shape, a prolate spheroidal shape. The shape facilitates spinning of the football about its longitudinal axis, providing the spinning football with the ability to slice through the air when thrown or kicked. The velocity of the spin and the tightness of the spiral affect the ability of the football to move through the air when being thrown.

Figure 1:
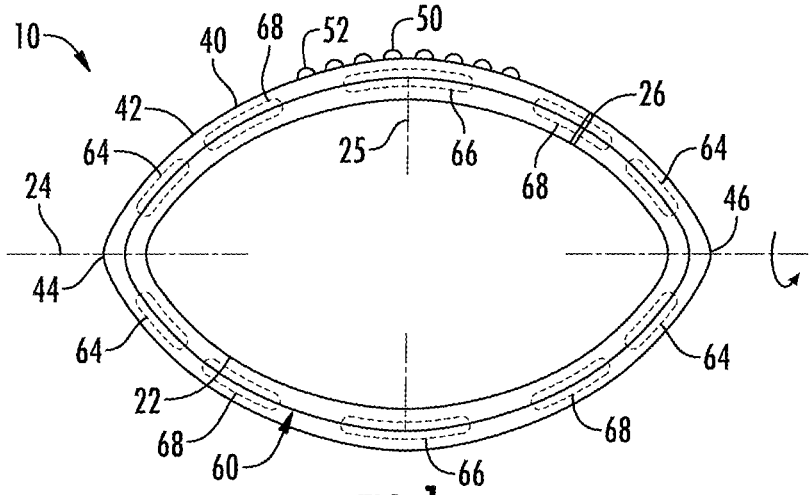
FIG. 1 is a sectional view schematically illustrating portions of an example American-style football.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed herein are various examples of an American-style football that requires less effort and/or skill by a player to impart spin to the football when thrown. The disclosed examples of American-style footballs are configured so as to have a lower MOI when measured about a longitudinal axis of the football. Such examples of footballs require a reduced degree of effort and/or skill required to impart spin to the football to achieve a tight spiral motion when thrown.

The example implementations of this application illustrate methods and football constructions that modify the moment of inertia (MOI) of a football about an axis, such as the longitudinal axis of the football. The example implementations redistribute weight toward the desired axis of rotation, such as the longitudinal axis, which reduces the MOI of the football. By reducing the MOI of the football, the ability of a player, such as a quarterback, to impart spin to a ball is increased. For a given torque applied to a football, a football with a lower MOI will result in higher spin rates, and higher MOI footballs will result in lower spin rates. In the present application, example implementations are provided that uniquely modify the construction process of the football in order to reduce the MOI of the football thus advantageously altering a player's ability to impart spin on the ball.

Figure 31:
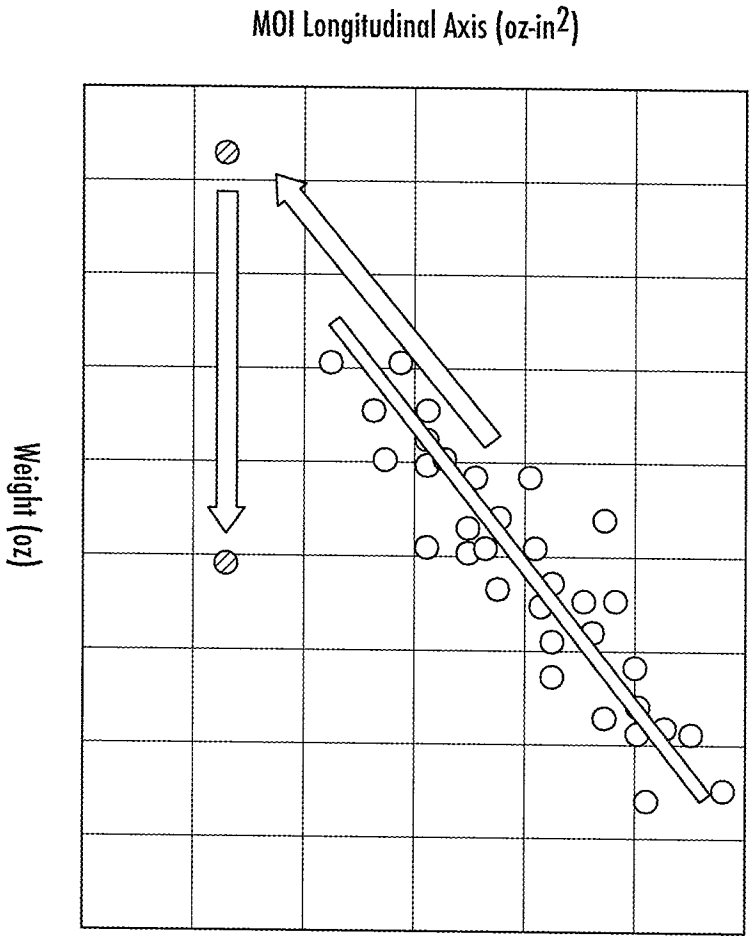
FIG. 31 is a graph showing MOI/weight characteristics of existing footballs and a football built in accordance with an implementation of the present invention.

Many of the implementations redistribute weight towards the desired axis of rotation, by removing weight from a certain area or location of the football and adding that same weight (or similar amount of weight) back into the football at a new location closer to the axis of rotation. Implementations of the lower MOI football include removing weight from the football by skiving or trimming outer cover layers, such as leather cover panels, placing holes or perforations in the lining of the football, using lower density materials for the lining, using lightweight bladder materials or a lighter lacing. FIG. 31 provides a representation of this process. The group of dots represent weight and MOI measurements of footballs taken with respect to the longitudinal axis of the footballs. The measurements generally follow a linear path with the MOI increasing as the weight increases. The present implementations redistribute the weight by one of many different methods to lower both the weight and the MOI of the football, then weight is added back into the football at or near the longitudinal axis, which has little or no effect on the MOI. The result is a football that meets applicable weight requirements of any applicable football organization while also providing a unique, exceptionally low MOI with respect to the longitudinal axis. The reduced MOI football is easier to spin when throwing or kicking. Therefore, a player, such as a quarterback, can more easily impart spin to the football during play, which typically results in improved accuracy, improved distance and increased spiral efficiency (or a tighter spiral effect).

In some implementations, the weight can be added back to the football by means of electronics such as sensors, transmitters, batteries placed within the football. In other implementations, the weight can be another substance of high density.

Applicant has identified that by redistributing 10-35 grams of weight, the MOI of the football about the longitudinal axis can be reduced by 3 to 10 oz-in$^2$. A 3 oz-in$^2$ reduction can represent a 10 percent reduction in MOI. Many athletic associations designate a weight range of 14 to 15 ounces (397 to 425 grams) for an approved football. Applicant has identified that existing Wilson® GST® Footballs configured for use in college and high school football have MOI values about a longitudinal axis of the football of 92 oz-in$^2$ at a weight of 14 ounces, and 101 oz-in$^2$ at a weight of 15 ounces. Additionally, Wilson® professional style footballs have MOI values about a longitudinal axis of the football of 96 oz-in$^2$ at a weight of 14 ounces, and 108 oz-in$^2$ at a weight of 15 ounces. Table 1 below illustrates how the MOI of such footballs constructed in accordance with implementations of the present application can result in significantly lower MOI values with respect to the longitudinal axis.

TABLE 1

Football MOI Values

| Football | Axis of Rotation | MOI value in oz-in$^2$ at Football Weight of 14 Ounces | MOI value in oz-in$^2$ at Football Weight of 15 Ounces | Percent Decrease in MOI |
|---|---|---|---|---|
| Wilson ® GST ® | Longitudinal | 92 | 101 | |
| GST ® Prototype 1 (0.35 oz transferred) | | 90 | 99 | |
| GST ® Prototype 2 (1.23 oz transferred) | | 83 | 91 | |
| GST ® Prototype 3 (3.10 oz transferred) | | 76 | 85 | |
| Wilson ® GST ® | Transverse 0 degree | 158 | 174 | |
| GST ® Prototype 1 (0.35 oz transferred) | | 155 | 168 | |
| Wilson ® GST ® | Transverse 90 degree | 155 | 170 | |
| GST ® Prototype 1 (0.35 oz transferred) | | 153 | 165 | |
| Wilson ® professional design | Longitudinal | 96 | 108 | |
| Professional Prototype 1 (0.35 oz transferred) | | 94 | 103 | |
| Wilson ® professional design | Transverse 0 degree | 160 | 179 | |
| Professional Prototype 1 (0.35 oz transferred) | | 157 | 172 | |

TABLE 1-continued

| Football MOI Values | | | | |
|---|---|---|---|---|
| Football | Axis of Rotation | MOI value in oz-in$^2$ at Football Weight of 14 Ounces | MOI value in oz-in$^2$ at Football Weight of 15 Ounces | Percent Decrease in MOI |
| Wilson ® professional design | Transverse 90 degree | 156 | 174 | |
| Professional Prototype 1 (0.35 oz transferred) | | 154 | 165 | |

Table 1: Moment of Inertia Values

In some implementations, the American-style football reduces the weight of a prolate spheroidal shaped intermediate layer, sometimes referred to as a "liner" that extends about and is in direct contact with a bladder of the football. The intermediate layer or lining enables the football to retain its desired shape and firmness. In one implementation, the mass is uniformly reduced across the intermediate layer; however, due to the prolate spheroidal shape of the intermediate layer, a smaller percentage of the mass reduction occurs proximate the longitudinal axis of the football and a larger percentage of the mass reduction occurs most distant the longitudinal axis of the football to reduce the MOI of the football.

In one implementation, the mass of the intermediate layer is reduced through the provision of layer voids. For purposes of this disclosure, a "layer void" comprises portions of the layer where material has been removed, omitted or replaced with air pockets. A layer void may consist of at least one of a perforation, a depression or an encapsulated pocket of air or cell, such as in a foamed material. A layer void does not encompass spacings between individual fibers or threads of a fabric. In implementations where the layer void comprises one or more perforations, the one or more perforations collectively define as an area of at least 2.0 in$^2$ of the entire area of the intermediate layer (or liner layer). In another implementation, the one or more perforations define an area of at least 4.0 in$^2$ of the entire area of the intermediate layer (or liner layer). In another implementation, the one or more perforations define an area of at least 12.0 in$^2$ of the entire area of the intermediate layer (or liner layer).

In one implementation, the layer voids are provided in the form of patterns of perforations that completely extend through the intermediate layer. In one implementation, the intermediate layer has a single pattern of perforations extending throughout. In another implementation, the intermediate layer has a plurality of perforation patterns. In one implementation, the perforation patterns mirror one another as they extend to opposite noses (or ends) of the football. In one implementation, the individual perforations are in the form of diamonds, triangles or other geometric shapes, that can contribute to the formation of a truss-like grid for enhanced strength.

In one implementation, the intermediate layer is formed by a plurality of oval-shaped panels having opposite endpoints, wherein the panels, when joined or otherwise supported adjacent to one another, edge-to-edge, form a prolate spheroidal shape corresponding to the prolate spheroidal shape of the bladder against which the panels directly contact. In such an implementation, each of the panels may have a controlled pattern or multiple controlled patterns of layer voids. In one implementation, at least one of the panels may include a pair of patterns of layer voids that mirror one another as they extend towards the opposite endpoints of the oval-shaped panels, which ultimately form, with other oval-shaped panels, the noses or ends of the football. In one implementation, the panels include individual perforations in the form of diamonds, triangles, other geometric shapes and/or combinations thereof that contribute to the formation of a truss-like grid for enhanced strength.

In some implementations, the American-style football is provided with a low MOI by utilizing a non-uniform layer in the football's construction, wherein the non-uniform layer has non-uniform distribution of mass providing a greater mass proximate the central or longitudinal axis of the football. In some implementations, the non-uniform layer shifts mass amongst different portions of the layer while maintaining the overall mass or weight of the football without such shifting of weight. In some implementations, the overall mass or weight of the football is maintained to within ranges demanded by regulating bodies thereby enabling the football to remain qualified for use in particular leagues or competitions. In some implementations, the shifting of the mass amongst different portions of the layer maintains the durability of the football. In some implementations, shifting the mass amongst different portions of the layer occurs in a symmetrical fashion with respect to the longitudinal axis of the football to maintain a balanced distribution of mass about the longitudinal axis.

Disclosed is an example American-style football that comprises a prolate spheroidal shaped bladder having a longitudinal axis, an outermost layer (or cover) about the bladder, a lacing featuring a series of parallel projections extending from an exterior of the outermost layer, and a non-uniform layer sandwiched between the bladder and the outermost layer. The non-uniform layer has a non-uniform distribution of mass providing a greater mass proximate the longitudinal axis thereby decreasing the MOI of the football with respect to the longitudinal axis.

FIG. 1 is a sectional view illustrating portions of an example American-style football 10. Football 10 is configured so as to have a lower MOI with respect to a longitudinal or central axis 24 of the football 10, reducing the degree of effort and/or skill required to impart spin to the football to achieve a tight spiral. To provide the American-style football with such a low MOI, the football is formed with a non-uniform layer in its construction, wherein the non-uniform layer has non-uniform distribution of mass providing a greater mass proximate the longitudinal axis 24. Football 10 comprises bladder 22, outermost layer 40, lacing surface 50 and non-uniform layer 60.

Bladder 22 has a prolate spheroidal shape extending along a longitudinal axis, which also serves as the longitudinal axis 24 of football 10. Bladder 22 forms a core of football 10 and is generally inflatable. In one implementation, bladder 22 comprises an inflatable air bladder that receives and retains compressed air through a valve assembly 26. The valve assembly 26 allows air to enter bladder 22 through use of an inflation needle (not shown) and, when removed, retain the air within bladder 22.

Bladder 22 may be formed from a substantially uniform layer of rubber-like material provided by at least one panel. In some implementations, bladder 22 can be formed by multiple panels bonded to one another such as through radiofrequency (RF) welding. In one implementation, bladder 22 is formed from two multi-layer sheets of flexible airtight material that are bonded to each other to form a bladder seam through RF welding. In yet other embodiments, bladder 22 may be seamless and formed from a single or multilayer sheet of material. In one implementation, bladder 22 may be formed from a polyester urethane or an ether urethane, but may be formed from other materials including other urethane materials, other polymeric materials, rubber, vinyl, EVA and combinations thereof.

Outermost layer 40 substantially covers the entire exterior surface of bladder 22 such that outermost layer 40 also has a prolate spheroidal shape. Outermost layer 40 provides an outermost surface 42 of football 10. This outermost surface, in some implementations, may be dimpled to facilitate gripping a football 10. In one implementation, the outermost surface may be a continuous molded layer of material. In another implementation, the outermost layer may be formed from multiple panels joined to one another along multiple seams. In one implementation, the outermost layer may be formed from a leather or synthetic leather. In yet other implementations, outermost layer may be formed from a polymer, a rubber or rubber-like material.

Lacing surface 50 features a series of parallel projections 52 that projects from the exterior surface 42 of the outermost layer 40 on one side of football 10, distant longitudinal axis 24 and generally centered between two noses or ends 44, 46 of football 10. Lacing surface 50 can provide multiple spaced grooves in which a person's fingers may be located when gripping football 10. Lacing surface 50 further provides a sufficient protrusion by which a person throwing football 10 may impart spin to football 10.

In one implementation, lacing surface 50 is formed by a lace or lacing, a string, or a large thread or line that is threaded through portions of the outermost layer 40. In one implementation, such lacing is formed along a seam of multiple panels which form the outermost layer 40. In yet other implementations, lacing may be formed in other locations between seams. In still other implementations, such as where outermost layer 42 of layer 40 is a molded layer of a polymer rubber-like material, lacing surface 50 may itself be adhered or welded onto the outer surface 40 or may be molded as part of the outermost layer 40.

Non-uniform layer 60 comprises a layer of material sandwiched between bladder 22 and the outermost layer 40. For purposes of this disclosure, a layer refers to the single continuous sheet or panel of material or multiple panels joined to one another adjacent or along their edges so as to be coplanar in the case of flat panels or so as form substantially serial curvatures in the case of curved panels. The term "substantially serial curvatures" refers to two consecutive portions that have non-parallel curvatures of the same radius, or radii, with respect to a common axis. In one implementation, the edges of the adjacent curved panels are end to end or edge to edge. In one implementation, end portions of adjacent panels may overlap one another, wherein a remainder of the nonoverlapping portions of the curved panels form substantially serial curvatures, or the nonoverlapping portions of the panels, the majority of the surface area of such panels, have nonparallel curvatures of the same radius about a common axis.

Non-uniform layer 60 can be formed with a non-uniform distribution of mass amongst different regions or portions of layer 60 so as to provide a greater mass proximate to longitudinal axis 24 relative to other regions or portions of layer 60 more distant from longitudinal axis 24. By having a greater mass proximate to longitudinal axis 24 in particular regions as compared to other regions more distant from longitudinal axis 24, non-uniform layer 60 reduces a MOI of football 10. The reduced MOI of football 10 reduces the degree of effort and/or skill required by a player to impart spin to the football to achieve a tight spiral when thrown.

Figure 2:
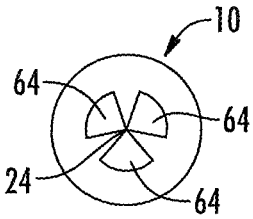
FIG. 2 is an end view of an example intermediate layer of the football of FIG. 1.
Figure 3:
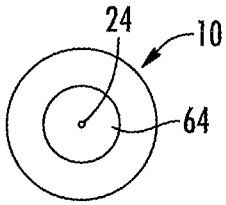
FIG. 3 is an end view of another example intermediate layer of the football of FIG. 1.

FIG. 1 identifies several examples of different regions of layer 60 about an along longitudinal axis 24 which may have different constructions so as to provide layer 60 with its non-uniformity and to provide a greater mass proximate longitudinal axis 24 and lesser mass at locations further away from the longitudinal axis 24. In the example illustrated, layer 60 may comprise nose proximate regions 64, nose distant regions 66 and intermediate regions 68. Nose proximate regions 64 comprise those portions or regions of layer 60 that are most proximate to or close to the two opposite ends 44, 46 of football 10. In some implementations, regions 64 may extend completely to the ends 44, 46. In some implementations, regions 64 may be uniformly spaced about longitudinal axis 24 as shown in FIG. 2. In other implementations, regions 64 may continuously extend about longitudinal axis 24 as shown in FIG. 3. The symmetrical layout of regions 64 may provide a more uniform spin of football 10 about axis 24 when being thrown. Nose proximate regions 64 provide a greater concentration of mass as compared to regions 66 and 68.

Figure 4:
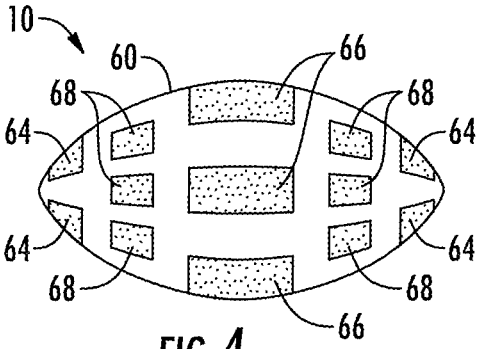
FIG. 4 is a side view of portions of the football of FIG. 1, illustrating another example intermediate layer.
Figure 5:
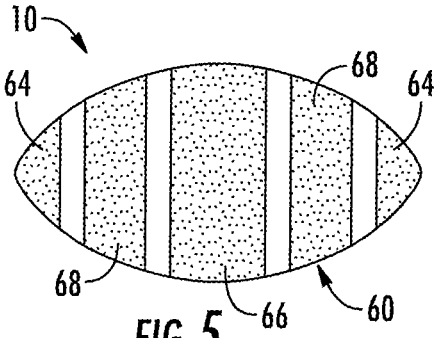
FIG. 5 is a side view of portions of the football of FIG. 1, illustrating another example intermediate layer.

Nose distant regions 66 comprise those portions or regions most distant axis 24, generally extending along and about the transverse axis 25 of football 10, the axis through football 10 that is perpendicular to axis 24 and that is equally spaced from noses or ends 44, 46. In a fashion similar to nose proximate regions 64, nose distant regions 66 may comprise a series of spaced regions generally centered along axis 25 extending about axis 24 (as shown in FIG. 4) or may comprise a continuous ring or loop extending along axis 25 about axis 24 (as shown in FIG. 5). Although football 10 is illustrated as comprising a specific number of distinct regions 66 angularly spaced about axis 24, football 10 may alternatively include a greater or fewer numbers of such regions 66 symmetrically and uniformly spaced about axis 24.

The symmetrical layout of regions 66 facilitates a more uniform spin of football 10 about axis 24 when being thrown. In some implementations, regions 66 may be selectively located about axis 24, especially in circumstances where other features of football 10 may already provide a non-uniform distribution of weight about axis 24, such as lacing surface 52. In such circumstances, the lower mass provided by regions 66 may be offset by the other features such that the reducing of the mass in all or particular regions 66 may actually enhance the balancing of weight or the symmetrical provision of weight about axis 24. In one implementation, as compared to regions 64 and 68, regions 66 provide a least amount of mass proximate longitudinal axis 24 to decrease the MOI of football 10.

Intermediate regions 68 comprise portions of layer 60 extending between regions 64 and 66 in a direction along axis 24. In one implementation, intermediate regions 68 may comprise a plurality of discrete regions uniformly located or spaced about axis 24 (as shown in FIG. 4). In another implementation, intermediate regions 68 may continuously extend around axis 24 in a symmetrical fashion about axis 24, such as in the form of a ring or loop (as shown by FIG. 5). In one implementation, intermediate regions 68 of layer 60 may provide a mass or a concentration of mass that is greater than that found in regions 66 but which is less than that found in regions 64.

Figure 6:
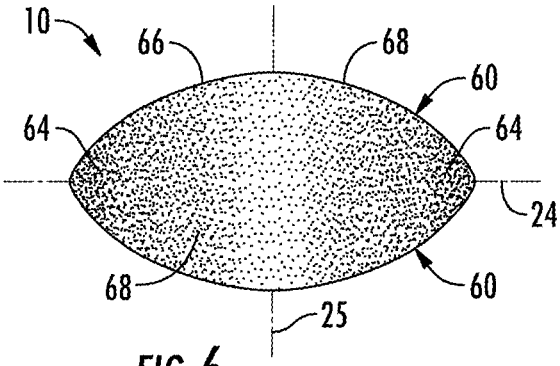
FIG. 6 is a side view of portions of the football of FIG. 1, illustrating another example intermediate layer.

In one implementation, regions 64, 66 and 68 comprise distinct regions in directions along axis 24. In another implementation, regions 64, 66 and 68 comprise regions that gradually blend or transition with respect to one another. For example, layer 60 may have a gradual mass or mass concentration reduction that changes in a continuous or gradually ramping fashion, gradually and continuously increasing from noses 44, 46 towards axis 25, as shown in FIG. 6, so as to form regions 64, 68 and 66. In other implementations, layer 60 may have distinct mass or mass concentration changes between noses 44, 46 and axis 25. For example, the mass may change in a stepwise manner from regions 64 to regions 68 and from regions 68 to regions 66. In some implementations, regions 68 may have a mass or mass concentration similar to that of regions 64 or similar to that of regions 66.

Figure 7A:
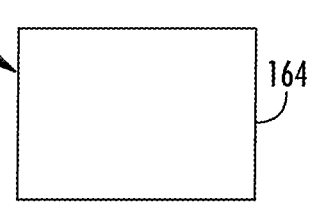
FIG. 7A is a plan view of a portion of an example intermediate layer of the football of FIG. 1.
Figure 8A:
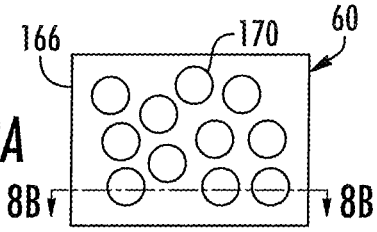
FIG. 8A is a plan view of a portion of an example intermediate layer of the football of FIG. 1.
Figure 7B:
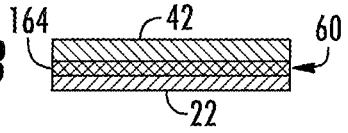
FIG. 7B is a sectional view of the portion of FIG. 7A sandwiched between a bladder and an outermost layer of the football of FIG. 1.
Figure 8B:
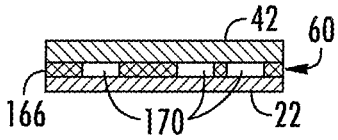
FIG. 8B is a sectional view of the portion of FIG. 8A sandwiched between a bladder and an outermost layer of the football of FIG. 1.

FIGS. 7A and 7B illustrate portion 164, an example of portion 64 while FIGS. 8A and 8B illustrate portion 166, an example of portion 66. FIGS. 7A and 8A are plan views of the illustrated portions of layer 60 while FIGS. 7B and 8B are sectional views of such portions further illustrating bladder 22 and the outermost layer 40 between which layer 60 is sandwiched. It should be appreciated that although no other layers are illustrated as also being sandwiched between bladder 22 and outermost layer 42, an additional layer or multiple additional layers may be sandwiched between bladder 22 and layer 60 or between layer 60 and the outermost layer 42.

As evident from a comparison of FIGS. 7B and 8B, portions 164 and 166 of layer 60 have substantially similar thicknesses. For purposes of this disclosure, the term "substantially" means within 10%. In one implementation, portions 164 and 166 of layer 60 have similar material compositions. A material "composition" refers to the chemical makeup of the material or combination of materials that form the particular layer. Such "composition" does not encompass the shape (smooth, rough, perforate, imperforate, dimpled, grooved or the like), form (solid, fabric, foamed or the like), or dimensions (thickness or other dimension of the material).

In other implementations, portions 164 and 166 may have different thicknesses and/or different material compositions. For example, portion 166 may be thinner as compared to portion 164 to reduce the weight of portion 166 to reduce the MOI of football 10. Portion 166 may have a material composition that has a lower material density, a lower weight per unit of volume, to reduce the weight of portion 166 to reduce the MOI football 10. In some implementations, portion 166 may have a material composition that has a greater degree of stretch-ability or a greater degree of strength as compared to the material composition of portion 164, enhancing the ability of portion 166 to maintain its structural integrity during impact of football 10 despite the inclusion of perforations or despite a reduced thickness relative to portion 164 or other portions of layer 60.

As shown by FIGS. 8A and 8B, portion 166 comprises layer voids in the form of perforations 170. Perforations 170 extend completely through portion 166 of layer 60. Perforations 170 reduce the mass or weight of portion 166 as compared to the mass or weight of portion 164 for a given surface area value of layer 60. The reduced mass of portion 166 lowers the MOI football 10.

The size of each of perforations 170, the number of each of perforations 170 and the density of perforations 170 (the number perforations 170 per unit surface area of layers 60) may vary depending upon the material composition and thickness of those portions of layer 60 surrounding such perforations 170 as well as the desired structural strength of portion 166 given its location on football 10. Although perforations 170 are illustrated as being circular, perforations 170 may have a variety of other shapes, such as oval or polygonal shapes, irregular shapes and combinations thereof.

Figure 9A:
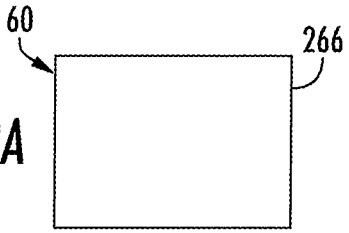
FIG. 9A is a plan view of a portion of an example intermediate layer of the football of FIG. 1.
Figure 9B:
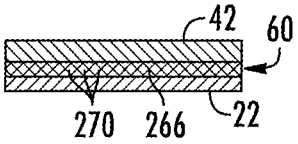
FIG. 9B is a sectional view of the portion of FIG. 9A sandwiched between a bladder and an outermost layer of the football of FIG. 1.

FIGS. 9A and 9B illustrate portion 266, another example of portion 66 of football 10. FIG. 9A illustrates portions of layer 60 while FIG. 9B is a sectional view of portion 266 while further illustrating bladder 22 and the outermost layer 40 between which layer 60 is sandwiched. It should be appreciated that although no other layers are illustrated as also being sandwiched between bladder 22 and outermost layer 42, an additional layer or multiple additional layers may be sandwiched between bladder 22 and layer 60 or between layer 60 and the outermost layer 40.

Similar to portion 166, portion 266 has a reduced mass for a given unit of surface area of layers 60 relative to portion 64 or 164. In contrast to portion 166 which utilizes perforations to reduce mass, portion 266 of layer 60 reduces mass with layer voids in the form of cells or air pockets 270 encapsulated within portion 266 of layer 60. In one implementation, portion 266 comprises a foamed material, closed cell or open cell. As compared to the solid form of portion 164, the foamed form of portion 266 has a lower mass per unit of layer 60 surface area.

Figure 10:
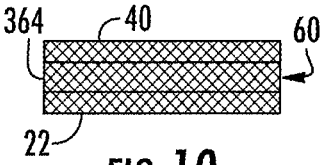
FIG. 10 is a sectional view of an example portion of the football of FIG. 1 sandwiched between a bladder and an outermost layer of the football of FIG. 1.
Figure 11:
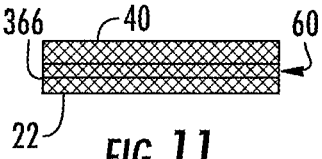
FIG. 11 is a sectional view of an example portion of the football of FIG. 1 sandwiched between a bladder and an outermost layer of the football of FIG. 1.

FIGS. 10 and 11 are sectional views of portions 364 and 366 of layer 60, examples of portion 64 and 66, sandwiched between bladder 22 and outermost layer 40. Portion 364 and portion 366 are similar to portions 164 and 166 described above except that portion 366 omits perforations 170, and portion 366 is thinner than portion 364. In the example illustrated, portions 364 and 366 have the same or similar material compositions. However, the reduced thickness of portion 366 provides portion 366 with a lower mass per unit of surface area of layers 60, reducing the MOI of football 10.

Figure 12:
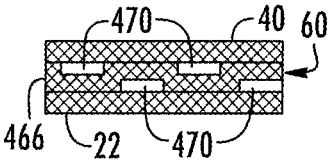
FIG. 12 is a sectional view of an example portion of the football of FIG. 1 sandwiched between a bladder and an outermost layer of the football of FIG. 1.

FIG. 12 is a sectional view of portion 466, an example portion 66, sandwiched between bladder 22 and outermost layer 40. Portion 466 is similar to portion 166 except that portion 466 replaces perforations 170 with layer voids in the form of depressions 470. Depressions 470 extend into at least one opposite face of layer 60 in portion 466 of layer 60. In the example illustrated, depressions 470 extend or project into both of the opposite main faces of layer 60 in portion 466. Depressions 470 may be in the form of craters, dimples, channels, grooves, recesses or the like. Depressions 470 may be molded into layer 60, may be etched from layer 60, or may be formed by material removal processes, such as cutting, grinding and the like. In the example illustrated, the layout of depressions 470 in the opposite faces of layer 60 is with interleaved upper and lower depressions 470 to assist in reducing structural weak points in portion 466 of layer 60. Because portion 466 has a lower mass per unit of surface area of layer 60 as compared to portion 164, 364 or another configuration for portion 64, portion 466 lowers or reduces the MOI of football 10 as compared to a layer 466 without such depressions 470.

Depressions 470, as well as perforations 170 and cells 270 provide their respective portions 166, 266 and 466 with a lower "density of material" (in contrast to a "material density") as compared to that of portion 64, 164 or 364. The lower density of material refers to the volume of material per unit of surface area of layers 60, not the density of the material itself, the density based upon the composition of the material. For example, the materials themselves may be identical and have identical material densities, but material omissions or gaps may be present reducing the density of material. The provision of cells, pockets, perforations or loan openings through or within the material reduces density of material, the volume of material per unit of area of layers 60.

Figure 13A:
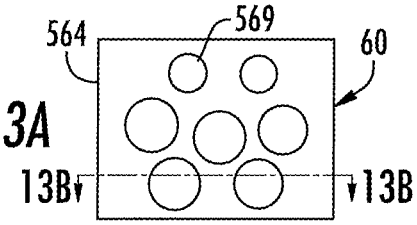
FIG. 13A is a plan view of a portion of an example intermediate layer of the football of FIG. 1.
Figure 13B:
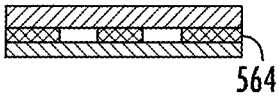
FIG. 13B is a sectional view of the portion of FIG. 13A sandwiched between a bladder and an outermost layer of the football of FIG. 1.
Figure 14A:
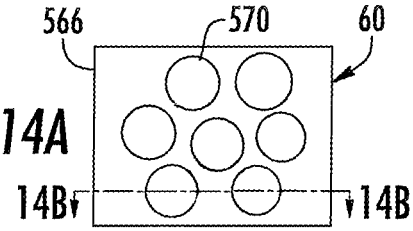
FIG. 14A is a plan view of a portion of an example intermediate layer of the football of FIG. 1.
Figure 14B:
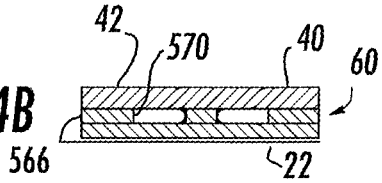
FIG. 14B is a sectional view of the portion of FIG. 14A sandwiched between a bladder and an outermost layer of the football of FIG. 1.

FIGS. 13A and 13B illustrate portion 564, an example of portion 64 while FIGS. 14A and 14B illustrate portion 566, an example of portion 66. FIGS. 13A and 13A are plan views of the illustrated portions of layer 60 while FIGS. 14B and 14B are sectional views of such portions further illustrating bladder 22 and the outermost layer 40 between which layer 60 is sandwiched. It should be appreciated that although no other layers are illustrated as also being sandwiched between bladder 22 and outermost layer 42, an additional layer or multiple additional layers may be sandwiched between bladder 22 and layer 60 or between layer 60 and the outermost layer 42.

As evident from a comparison of FIGS. 13B and 14B, portions 564 and 566 of layer 60 have substantially similar thicknesses. In other implementations, portions 564 and 566 may have different thicknesses and/or different material compositions. For example, portion 566 may be thinner as compared to portion 564 to reduce the weight of portion 566 to reduce the MOI of football 10. Portion 566 may have a material composition that has a lower material density, a lower weight per unit of volume, to reduce the weight of portion 566 to reduce the MOI football 10. In some implementations, portion 566 may have a material composition that has a greater degree of stretch-ability or a greater degree of strength as compared to the material composition of portion 564, enhancing the ability of portion 566 to maintain its structural integrity during impact of football 10 despite the inclusion of perforations or despite a reduced thickness relative to portion 564 or other portions of layer 60.

In the example illustrated, both portions 564 and 566 comprise perforations. Portion 564 comprises perforations 569 while portion 566 comprises perforations 570. Perforations 569 and 570 extend completely through portion 564 and 666, respectively, of layer 60. In the example illustrated, although perforations 570 have the same density in portion 566 (the number of perforations for the same given surface area of layers 60) as compared to perforations 569 in portion 564 of layer 60, perforations 570 are each individually larger than perforations 569. As a result, perforations 570 reduce the mass or weight of portion 566 as compared to the mass or weight of portion 564 for a given surface area value of layer 60. The reduced mass of portion 566 lowers the MOI football 10.

The particular size of each of perforations 570, the number of each of perforations 570 and the density of perforations 570 (the number perforations 170 per unit surface area of layers 60) may vary depending upon the material composition and thickness of those portions of layer 60 surrounding such perforations 570 as well as the desired structural strength of portion 166 given its location on football 10. Although perforations 570 are illustrated as being circular, perforations 570 may have a variety of other shapes, such as oval, polygonal shapes, irregular shapes and combinations thereof.

Figure 15A:
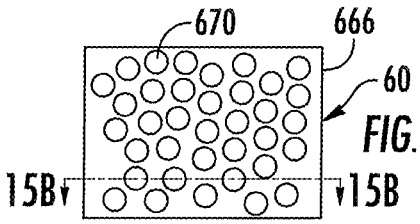
FIG. 15A is a plan view of a portion of an example intermediate layer of the football of FIG. 1.
Figure 15B:
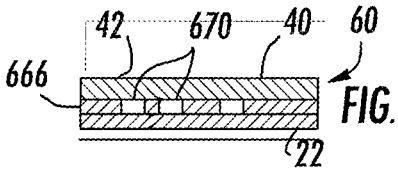
FIG. 15B is a sectional view of the portion of FIG. 15A sandwiched between a bladder and an outermost layer of the football of FIG. 1.

FIGS. 15A and 15B illustrate portion 666, an example of portion 66 of layer 60. Portion 666 may be used in conjunction with portion 564 or any of the above described portions 64, 164 or 364 so long as portion 66 has a lower mass for a given unit of surface area of layers 60 as compared to portion 64, 164 or 364. In contrast to portion 566, portion 666 comprises perforations 670 which are each individually smaller than the individual perforations 570 and also smaller than the individual perforations 569 of portion 564. However, such perforations 670 are provided in greater number per surface area of layers 60, a greater density of perforations. This greater density of perforations results in portions 666 having a lower mass per unit of surface area of layers 60 as compared to the other portions 564, 364, 164 64, reducing the MOI of football 10.

Figure 16A:
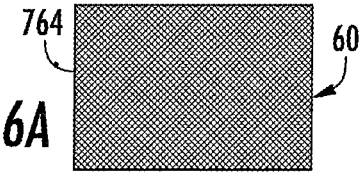
FIG. 16A is a plan view of a portion of an example intermediate layer of the football of FIG. 1.
Figure 17A:
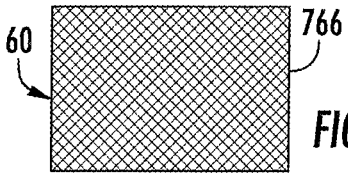
FIG. 17A is a plan view of a portion of an example intermediate layer of the football of FIG. 1.
Figure 16B:
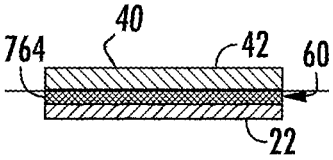
FIG. 16B is a sectional view of the portion of FIG. 16A sandwiched between a bladder and an outermost layer of the football of FIG. 1.
Figure 17B:
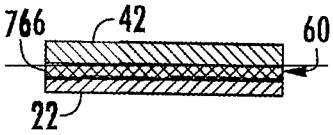
FIG. 17B is a sectional view of the portion of FIG. 17A sandwiched between a bladder and an outermost layer of the football of FIG. 1.

FIGS. 16A and 16B illustrate portion 764, an example of portion 64 while FIGS. 17A and 17B illustrate portion 766, an example of portion 66. FIGS. 16A and 17A are plan views of the illustrated portions of layer 60 while FIGS. 16B and 17B are sectional views of such portions further illustrating bladder 22 and the outermost layer 40 between which layer 60 is sandwiched. It should be appreciated that although no other layers are illustrated as also being sandwiched between bladder 22 and outermost layer 42, an additional layer or multiple additional layers may be sandwiched between bladder 22 and layer 60 or between layer 60 and the outermost layer 42.

As evident from a comparison of FIGS. 16B and 17B, portions 764 and 766 of layer 60 have substantially similar thicknesses. In other implementations, portions 764 and 766 may have different thicknesses and/or different material compositions. For example, portion 766 may be thinner as compared to portion 764 to reduce the weight of portion 766 to reduce the MOI of football 10. Portion 766 may have a material composition that has a lower material density, a lower weight per unit of volume, to reduce the weight of portion 766 to reduce the MOI football 10. In some implementations, portion 766 may have a material composition that has a greater degree of stretch ability or a greater degree of strength as compared to the material composition of portion 764, enhancing the ability of portion 766 to maintain its structural integrity during impact of football 10 despite the inclusion of perforations or despite a reduced thickness relative to portion 764 or other portions of layer 60.

In the example illustrated, both of portion 764 and 766 are in the form of fabrics. For purposes of this disclosure, a "fabric" refers to a flexible network of individual fibers or threads, whether a woven, knitted or felted fabric. In one implementation, both of portions 764 and 766 are flexible and resiliently stretchable. For example, in one implementation, both of portions 764 and 766 are formed from an elastomeric fibrous material. In other implementations, both of portion 764 and 726 may be formed from other materials such as a rubber, a latex, ethyl vinyl acetate (eva) or other polymeric elastomeric materials. In some implementations, portions 764 and 766 may be formed from different materials or combination of materials that form a network of threads or fibers. For example, portion 764 may be formed from fibers or threads having a larger material density, a composition having a greater density, as compared to the material forming the fibers or threads of portion 766. The density of materials, such as rubber compounds, can be increased by adding compounds such as Tungsten and Barium Sulfate to increase the overall density of the layer or component of the football utilizing the material.

As evident from a comparison of FIGS. 16A and 17A, portion 766 comprises lower density fabric as compared to portion 764. In other words, portion 764 has a lower number of threads or fibers per unit volume or per unit surface area of layer 60 as compared to portion 764. In some implementations, lower number of threads or fibers per unit volume may be achieved using a tighter weave, a tighter knit or a more compact felting. In implementations where such threads are fibers and have the same material composition, lower density of the fabric of portion 766 provides portion 766 with a lower mass per unit surface area of layers 60 to reduce the MOI of football 10. As indicated above, in some implementations, lower mass of portion 766 may be further exacerbated through the use of fibers having material composition such that the individual fibers also have a lower material density. In some implementations, to maintain structural integrity, portion 766 may be formed from fibers of a different material composition than that of the fibers of portion 764, wherein the different fibers having greater stretch ability or a greater strength to compensate for the lower density of fabric (the number of threads or fibers per unit volume) of portion 766.

Figure 18A:
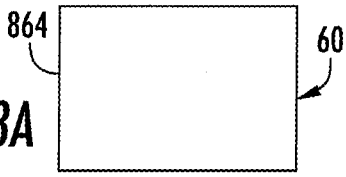
FIG. 18A is a plan view of a portion of an example intermediate layer of the football of FIG. 1.
Figure 19A:
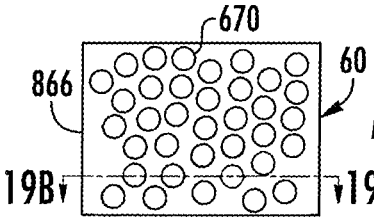
FIG. 19A is a plan view of a portion of an example intermediate layer of the football of FIG. 1.
Figure 18B:
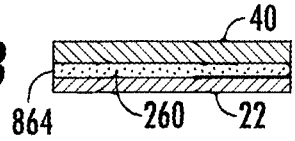
FIG. 18B is a sectional view of the portion of FIG. 18A sandwiched between a bladder and an outermost layer of the football of FIG. 1.
Figure 19B:
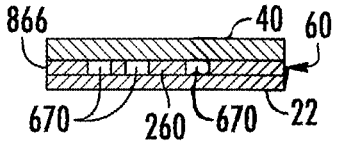
FIG. 19B is a sectional view of the portion of FIG. 19A sandwiched between a bladder and an outermost layer of the football of FIG. 1.

FIGS. 18A and 18B illustrate portion 864, an example of portion 64 while FIGS. 19A and 19B illustrate portion 866, an example of portion 66. FIGS. 18A and 19A are plan views of the illustrated portions of layer 60 while FIGS. 18B and 19B are sectional views of such portions further illustrating bladder 22 and the outermost layer 40 between which layer 60 is sandwiched. It should be appreciated that although no other layers are illustrated as also being sandwiched between bladder 22 and outermost layer 42, an additional layer or multiple additional layers may be sandwiched between bladder 22 and layer 60 or between layer 60 and the outermost layer 42.

As evident from a comparison of FIGS. 18B and 19B, portions 864 and 866 of layer 60 have substantially similar thicknesses. In other implementations, portions 864 and 866 may have different thicknesses and/or different material compositions. For example, portion 866 may be thinner as compared to portion 864 to reduce the weight of portion 866 to reduce the MOI of football 10. Portion 866 may have a material composition that has a lower material density, a lower weight per unit of volume, to reduce the weight of portion 866 to reduce the MOI football 10. In some implementations, portion 866 may have a material composition that has a greater degree of stretchability or a greater degree of strength as compared to the material composition of portion 864, enhancing the ability of portion 866 to maintain its structural integrity during impact of football 10 despite the inclusion of perforations or despite a reduced thickness relative to portion 864 or other portions of layer 60.

As shown by FIGS. 18B and 19B, both of portions 864 and 866 comprise encapsulated internal pockets or cells 270 within portion 266 of layer 60. In one implementation, both of portions 864 and 866 comprise a foamed material, closed cell or open cell. In the example illustrated, portion 866 comprise a less dense foam as compared to that of portion 864. Portion 866 has a greater size of cells 260 and/or a greater density of cells 260 as compared to portion 864. As a result, portion 866 is a lower mass per unit surface area or per unit volume of layer 60 as compared to portion 866 so as to reduce the MOI of football 10.

As further shown by FIGS. 19A and 19B, portion 866 of layer 60 is further provided with perforation 670 (described above). Perforation 670 further reduce the mass of portion 866 as compared to the mass of portion 864. Although not illustrated, in some implementations, portion 864 layer 860 may also include perforations 569 (described above), wherein perforations 569 are sized or are numbered such that portion 866 still has a larger mass as compared to portion 864.

Figure 20A:
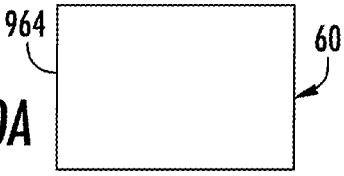
FIG. 20A is a plan view of a portion of an example intermediate layer of the football of FIG. 1.
Figure 21A:
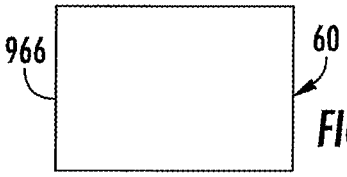
FIG. 21A is a plan view of a portion of an example intermediate layer of the football of FIG. 1.
Figure 20B:
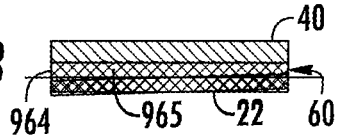
FIG. 20B is a sectional view of the portion of FIG. 20A sandwiched between a bladder and an outermost layer of the football of FIG. 1.
Figure 21B:
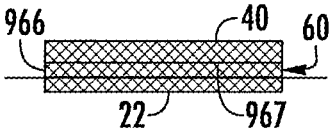
FIG. 21B is a sectional view of the portion of FIG. 21A sandwiched between a bladder and an outermost layer of the football of FIG. 1.

FIGS. 20A and 20B illustrate portion 964, an example of portion 64 while FIGS. 21A and 21B illustrate portion 966, an example of portion 66. FIGS. 20A and 21A are plan views of the illustrated portions of layer 60 while FIGS. 20B and 21B are sectional views of such portions further illustrating bladder 22 and the outermost layer 40 between which layer 60 is sandwiched. It should be appreciated that although no other layers are illustrated as also being sandwiched between bladder 22 and outermost layer 42, an additional layer or multiple additional layers may be sandwiched between bladder 22 and layer 60 or between layer 60 and the outermost layer 42.

As evident from a comparison of FIGS. 20B and 21B, portions 864 and 866 of layer 60 have substantially similar thicknesses. In other implementations, portions 964 and 966 may have different thicknesses. For example, portion 966 may be thinner as compared to portion 864 to reduce the weight of portion 966 to reduce the MOI of football 10. Portions 964 966 are formed from different materials. Portion 964 is formed from a first material 965 while portion 966 is formed from a second different material 967. Material 966 has a composition that has a lower material density, a lower weight per unit of volume, as compared to the material density of material 965 of portion 964. The lighter material composition of material 967 reduces the weight of portion 966 to reduce the MOI football 10. In some implementations, portion 966 may have a material composition that has a greater degree of stretchability or a greater degree of strength as compared to the material composition of portion 964, enhancing the ability of portion 866 to maintain its structural integrity during impact of football.

In each of the above illustrated implementations, football 10 is illustrated as having a non-uniform intermediate layer 60 having different regions or portions with different masses. In other implementations, layer 60 may have a substantially uniform set of layer voids, perforations 170, 570, 670, cells 270 or depressions 470 throughout. In other words, the entirety of layer 60 is similar to portion 166, portion 266, portion 466, portion 566, portion 666 or portion 866. Due to the prolate spheroidal shape of the intermediate layer 60, a smaller percentage of the mass reduction occurs proximate the longitudinal axis of the football and a larger percentage of the mass reduction occurs most distant the longitudinal axis of the football to reduce the MOI of the football. In some implementations, intermediate layer 60 may be formed from multiple oval-shaped panels having substantially pointed tips or endpoints, wherein each of the panels has a substantially consistent distribution of layer voids. In some implementations, each of the panels may include a single controlled pattern of layered voids or multiple controlled pattern of layered voids, such as a single pattern of perforations or depressions or multiple mirroring patterns of perforations or depressions.

Figure 22:
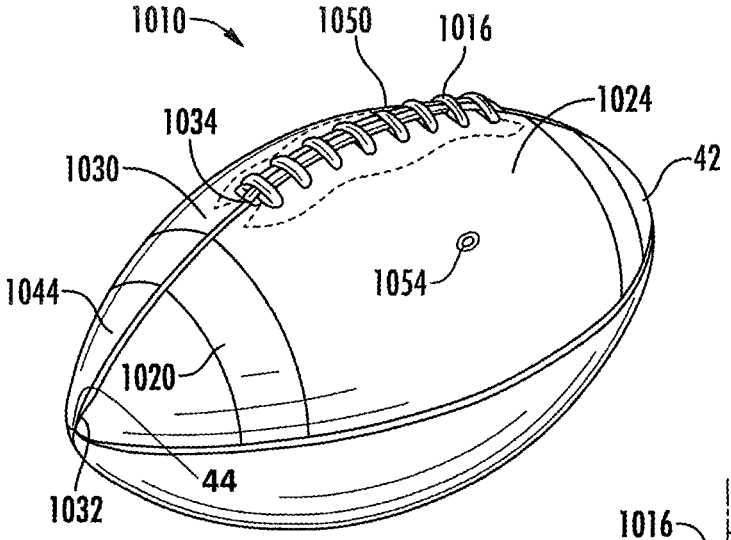
FIG. 22 is a perspective view of an example American-style football.
Figure 22A:
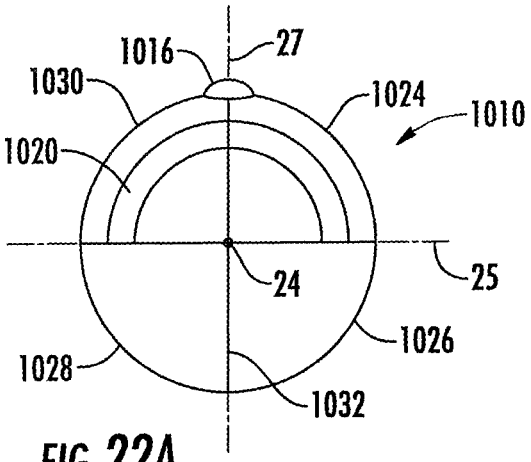
FIG. 22A is an end view of the football of FIG. 22.
Figure 23:
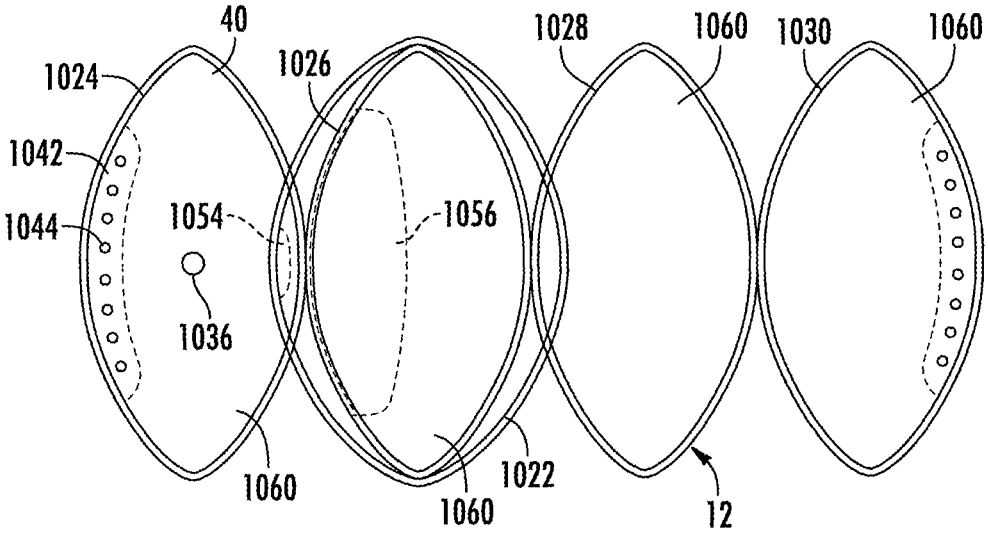
FIG. 23 is an exploded perspective view of the football of FIG. 22.

FIGS. 22-27 illustrate an example American-style football 1010. FIG. 22 is a top, side perspective view of football 1010 and FIG. 22A is an end view of the football 1010. Football 1010 includes longitudinal axis 24 and a pair of transverse axes 25 and 27 that extend perpendicular to the longitudinal axis 24 through the center of the football 1010. Axis 25 is also referred to as a 0-degree transverse axis, and axis 27 is also referred to as a 90-degree transverse axis. Similar to football 10, football 1010 is configured so as to have a lower MOI, reducing the degree of effort and/or skill required to impart spin to the football. To provide the American-style football with such a low MOI, the football is formed with a non-uniform layer in its construction, wherein the non-uniform layer has non-uniform distribution of mass providing a greater mass proximate the longitudinal axis 25 and less mass in regions further away from the longitudinal axis. Football 1010 comprises bladder 1022, outermost layer 1040, lacing surface 1050 and intermediate layer 1060.

Bladder 1022 (shown in FIGS. 23-25) is similar to bladder 22 described above. Bladder 1022 may comprise an inflatable air tube having a generally prolate spheroidal shape. The bladder may be inserted into a cover formed by the outermost layer 1040 through a slot 1034. Alternatively, outermost layer 40 and the intermediate layer 1060 may be formed over or applied to bladder 1022. Bladder 1022 receives and retains compressed air through a valve assembly 1054 mounted to the bladder 1022. The valve assembly 1054 is configured to allow air to enter the bladder through use of an inflation needle (not shown) and, when removed, retain the air within the bladder 1022. In the example illustrated, bladder 1022 may include a flap 1056 positioned beneath the location of lacing surface 1050 for further protecting bladder 1022 from the lacing 1016 providing lacing surface 1052. Flap 1056 may be formed of a flexible material, such as vinyl. At least one edge of the flap 1056 may be bonded to the bladder 1022 through a radiofrequency welding. Alternatively, the flap 1056 may be formed from other materials, such as, for example, urethane, a neoprene, a thermoplastic, fabric, rubber, EVA, leather, a foam layer, other polymeric material, or combinations thereof. In such other embodiments, the flap 1056 may be attached to the inner surface of the cover or another in immediate layer overlying bladder 1022. In some implementations, football 1010 may be formed without flap 1056.

In one implementation, bladder 1022 is formed of two multilayer sheets of flexible airtight material that are bonded to each other to form a bladder seam 1058. Bladder seam 1058 defines an expandable cavity within the bladder 1022. In other implementations, other means for forming an airtight bond between the two sheets 1062 of material may be employed, such as, thermal bonding, chemical bonding, adhesive bonding, stitching, press fitting, clamping and combinations thereof. Bladder seam 1058 extends generally longitudinally about the football 1010. In other implementations, bladder seam 1058 may be one or more seams extending longitudinally, laterally, in a helical manner or in other path about the bladder 1022. In other implementations, bladder 1022 may be seamless and formed of the single or multilayer sheet of material. Examples of material from which bladder 1022 may be formed include, but are not limited to, a polyester urethane, and either urethane, other urethane materials, other polymeric materials, rubber, vinyl, EVA and combinations thereof.

Figure 25:
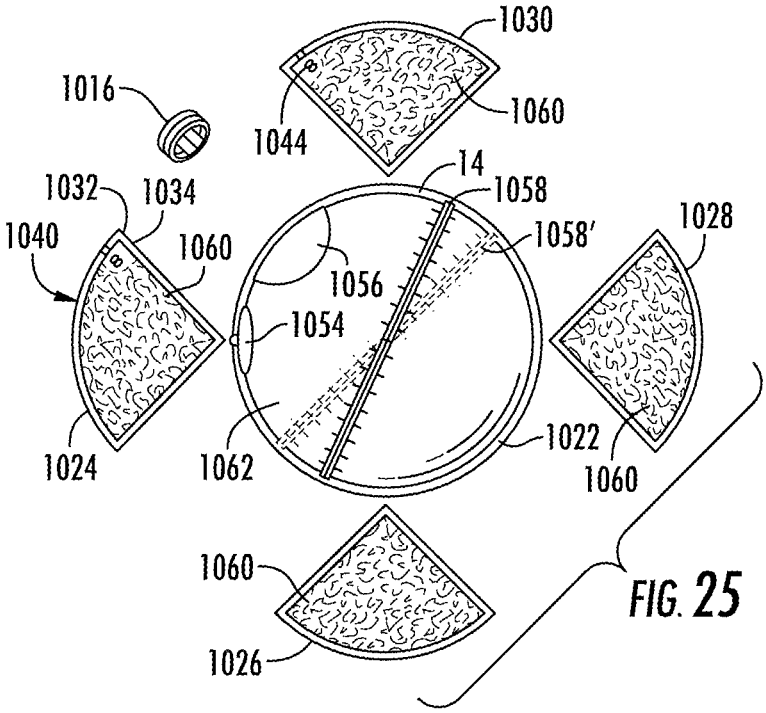
FIG. 25 is an exploded end view of the football of FIG. 22.

As illustrated by FIG. 25, bladder seam 1058 is positioned away or angularly spaced from the longitudinal seam of the different panels forming the outermost layer 1040 with respect to the longitudinal axis 24 or longitudinal axis of football 1010 such that a seam 1032 and the bladder seam 1058 do not directly overlie one another. In other implementations, the bladder seam 1058' may be rotated such that is in line with one or more of seams 1032.

In the example illustrated, the various sheets 1062 forming bladder 1022 may be positioned such that the generally, longitudinally extending bladder seam 1058 is positioned such that bladder seam 1058 does not interfere with a typical punt or kickoff of the football 1010. The bladder seam 1058 is positioned such that it does not interfere with the side of football opposite the lacing 1016. The flap 1056 indicates the location the lacing 1016 over bladder 1022 on the assembled football 1010. As a result, the side of the football 1010 opposite the lacing 1016, often referred to as the kicking region or kicking side of the football 1010, is substantially free from the bladder seam 1058. Punters and kickers typically rotate the football 1010 such that the laces are positioned away from the location where the punter or kicker punts or kicks of football. Accordingly, the bladder seam 1058 is advantageously positioned so as to not extend over the kicking region of football 1010 that is likely to be impacted by the foot of the punter or kicker.

Outermost layer 1040, sometimes referred to as a cover layer or cover, is a prolate spheroidal shaped outer body of football 1010. In the example illustrated, layer 1040 is formed from first, second, third and fourth cover panels 1024, 1026, 1028 and 1030 that are joined to one another along generally longitudinally extending seams 1032. The panels 1024-1030 are preferably stitched to one another. In other implementations, the panels may be bonded, fused, stapled or otherwise fastened together with or without stitching. The longitudinal seam 1032 connecting the first and fourth panel 1024 and 1030 may include a longitudinally extending slot 1034 which provides an opening for the insertion of bladder 1022 and, if applicable, other layers of material to be applied over the bladder 1022. The first cover panel 1024 may include a valve aperture 1036. Cover panels 1024 and 1030 may additionally include lace holes 1044 through which lacing 1016 may be threaded.

In the example illustrated, the lacing region of the cover panels 1024 and 1030 can further include a reinforcing panel 1042 for increasing the strength and structural integrity to the laced region. Reinforcing panel 1042 may be formed from the same material as the intermediate layer 1060. In other implementations, other materials may be utilized for the reinforcing panels 1042 and also can include the lace holes 1044. In other implementations, the cover panels can be formed without a reinforcing panel adjacent the laced region.

Overall, the outermost layer 1040 or cover provide football 1010 with a durable grip-able outer surface. An outer surface of layer 1040 may include a pebbled texture for further enhancing the grip and improving the aesthetics of football 1010. In other implementations, the outermost layer 1040 may be formed of a single piece or of two, three, five or other numbers of cover panels. In one implementation, outermost layer 1040 may be formed from natural leather. In other implementations, outermost layer 1040 may be formed from other materials such as polyurethane, a synthetic leather, rubber, pigskin or other synthetic polymeric materials and/or combinations thereof.

In some applications, such as high school and college applications, footballs 1010 are formed with a plurality of stripes 1020. The stripes 1020 are positioned on the top surface or lacing side of the football 1010, such as cover panels 1024 and 1030 away from the kicking region of the football 1010. The stripes 1020 near the ends 44 and 46 of the football 1010. The stripe 1020 are typically formed of a different color than the cover panels. The stripes 1020 are coupled to one or more of the cover panels, such as cover panels 1024 and 1030. In one implementation, the stripes are bonded and stitched to the cover panels. In other implementations, the stripes may be attached to the cover or outermost layer of the football via stitching, thermal bonding, adhesive bonding, intermediate connecting pieces and combinations thereof. The stripes 1020 can be formed as a set of decals, as a fluid deposited on to the football and cured, as separate strips of material coupled to the cover panels. In one implementation, the stripes can be formed of a material that is more grip-able than the outer surface of the cover panels or outermost layer 1040. In other implementations, the stripes can be formed of a material that has similar grip-ability characteristics as the outer surface of the outermost layer or is less grip-able than many existing footballs.

Lacing surface 1050 is similar to lacing surface 50 described above. In the example illustrated, lacing surface 1050 is formed by a lacing 1016 which is threaded through holes 1044 of cover panels 1024 and 1030 at their junction to close slot 1034 through which bladder 1022 was inserted. Lacing 1016 provides multiple spaced grooves in which a person's fingers may be located when gripping football 1010. Lacing surface 1050 further provides a plurality of protrusions or projections to facilitate a player's ability to grasp and to throw the football 1010. Additionally, the projections or protrusions of the lacing surface 1050 can facilitate the player's ability to impart spin to football 1010.

Intermediate layer 1060, sometimes referred to as a liner or liner layer, comprises a layer sandwiched between the bladder 1022 and the outermost layer 1040. In the example illustrated, layer 1060 directly contacts the outer surface of bladder 1022. Intermediate layer 1060 may be applied via an adhesive to the inner surface of outermost layer 1040. In one implementation, intermediate layer 1060 is formed from a number of oval-shaped panels correspond to the shape and size of cover panels 1024-1030.

In one implementation, the intermediate layer 1060 can be sized to generally correspond to the one or more cover panels of the outermost layer 1040. In one implementation, the intermediate layer 1060 formed into four separate panels that correspond to the cover panels of the outermost layer 104. Each of the four panels of the intermediate layer 1060 can then be stitched to the associated cover panel of the outermost layer 1040. In another implementation, the intermediate layer 1060 can be applied via an adhesive to an inner surface of the outermost layer 1040. Alternatively, intermediate layer 1060, as a single piece or in the form of multiple panels, may be bonded, cured, stitched, sewn, press fit or otherwise fastened to the outermost layer 1040. In yet other implementations, intermediate layer 1060 may be a separate layer unattached to the outermost layer 1040. In some implementations, intermediate layer 1060 may be directly formed or positioned over the exterior surface of bladder 1022 prior to the positioning of the outermost layer 1040 about bladder 1022 and the intermediate layer 1060.

In one implementation, intermediate layer 1060 has a thickness of between 0.008 and 0.250 inch, and nominally 0.0435 inches with a weight of between 0.035 inch and 3.5 inches and nominally 1.3 ounces per panel, working out to be 37 ounces per square yard. In one implementation, when cover panels 1024 through 1030 are formed with corresponding panels or sections of the intermediate layer 1060, each cover panel and intermediate layer panel may have a combined weight within the range of 0.21 ounce to 3.75 ounces, with a nominal weight of 2.08 inches. In such an implementation, the cover panels 1024 through 1030 and their corresponding panels or pieces of intermediate layer 1060 can combine to account for approximately 50% to 65% of the overall weight of the football 1010. The remaining weight may be attributed to the lacing, the bladder, the air valve, and, if applicable, stripes, decals and additional layers.

Intermediate layer 1060 may be a layer of tough, durable material that increases strength and durability of football 1010. Intermediate layer 1060 may be formed from one or more layers of woven fabric and one or more layers of polyvinylchloride cured together to form an impregnable fabric layer. Alternatively, intermediate layer 1060 may be formed of a woven fabric, layers of fiber, rubber, a latex, ethyl vinyl acetate (EVA), other polymeric elastomeric materials and/or combinations thereof. Intermediate layer 1060 assists in carrying hoop stress of an inflated ball.

Figure 26A:
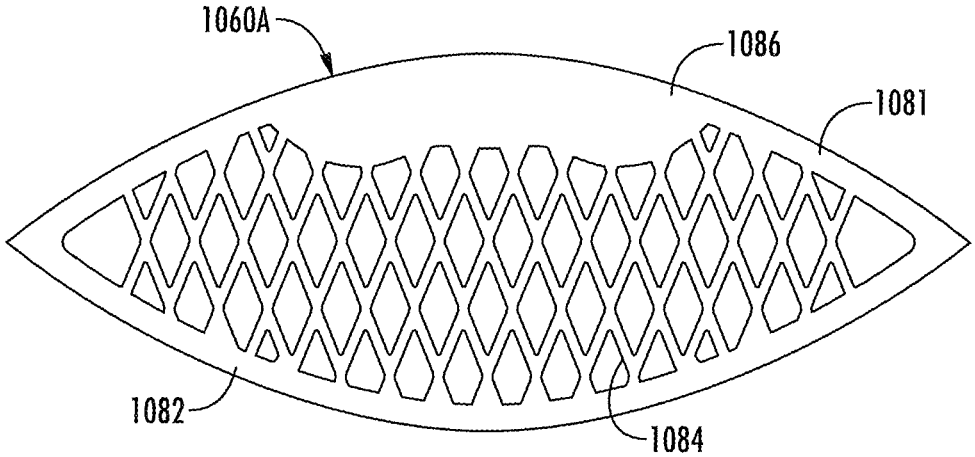
FIG. 26A is a plan view of an example first intermediate layer panel of the football of FIG. 22.
Figure 26B:
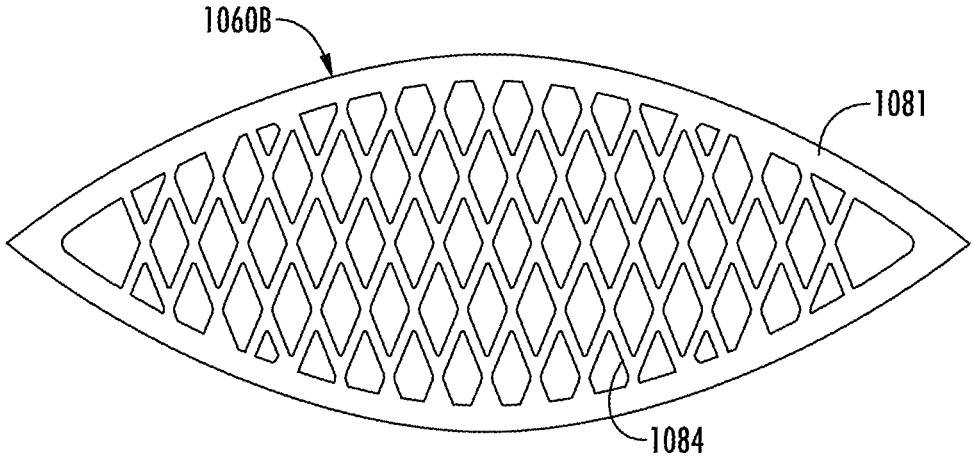
FIG. 26B is a plan view of an example second intermediate layer panel of the football of FIG. 22.

FIGS. 26A and 26B are plan views of example intermediate layer panels 1060A, 1060B for being positioned along cover panels 1024, 1030 and cover panels 1026, 1028, respectively. Intermediate layer panel 1060A, 1060B each comprise an outer frame portion 1081 and a uniform or consistent pattern of perforations 1084 which are diamond-shaped or polygonal-shaped. In other implementations, panel 1060A, 1060B may alternatively comprise corresponding diamond or other polygonal-shaped depressions (craters) extending into one or both faces of panel 1060A, 1060B, wherein the depressions correspond in shape, size and location to the perforations 1084. As further shown by FIG. 26A, cover panel 1060A comprises a generally imperforate or solid reinforcement region 1086 which is to underlie lacing 1016 of football 1010.

As shown by FIG. 26B, intermediate layer panel 1060B is identical to intermediate layer panel 1060A except that intermediate layer panel 1060B omits reinforcement region 1086. When intermediate layer panel 1060A is positioned beneath cover panels 1024 and 1030 and cover panel 1060B is positioned beneath cover panels 1026 and 1028, the four cover panels collectively form intermediate layer 1060. In one example where the intermediate layer panel 1060 is has a thickness of 0.435 inches, the intermediate layer panel 1060 has a mass reduction of 15.5 g, based upon a 39 g the intermediate layer panel without perforations. The illustrated perforations 1084 result in a total reduction of 2.4 ounces spread across or over the four intermediate layer panels 1060A, 1060B.

Figure 27A:
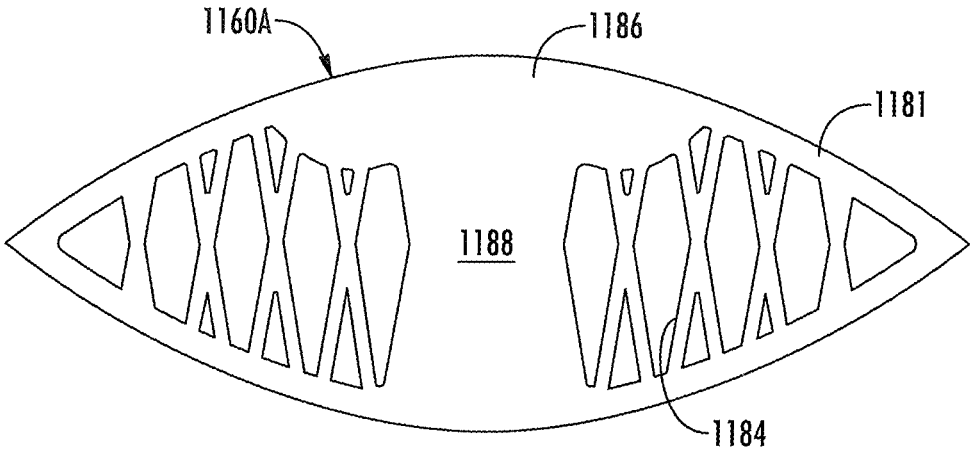
FIG. 27A is a plan view of an example first intermediate layer panel of the football of FIG. 22.
Figure 27B:
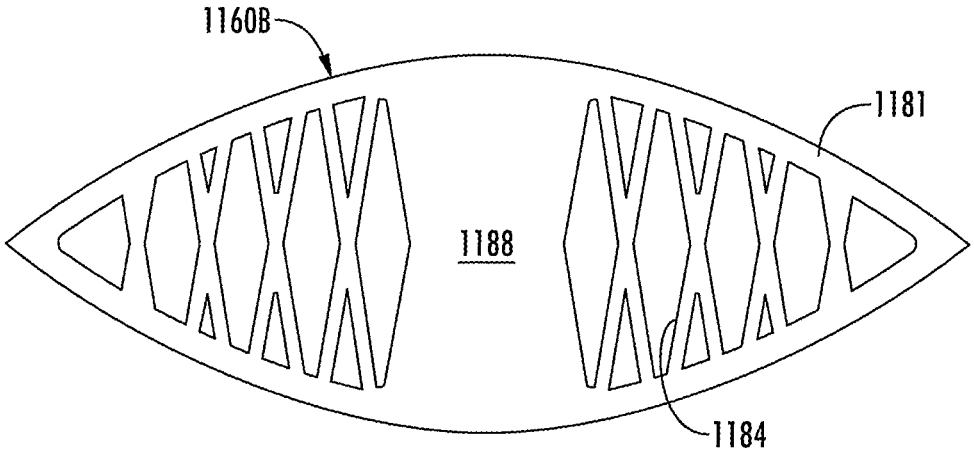
FIG. 27B is a plan view of an example second intermediate layer panel of the football of FIG. 22.

FIGS. 27A and 27B are plan views of other example intermediate layer panels 1160A, and 1160B for being positioning along with, or beneath, cover panels 1024, 1030 and cover panels 1026, 1028, respectively. Intermediate layer panels 1160A and 1160B each comprise an outer frame 1181 extending about a uniform cut pattern of diamond-shaped or other polygonal-shaped perforations 1184, but leave a large center section 1188 in the middle of the intermediate layer panels 1160A and 1160B. Although intermediate layer panels 1160A and 1160B remove a lower amount of mass as compared to panel 1060A, the large center section 1188 can enhance durability and structural integrity of the football 1010. Similar to intermediate cover panel 1060A, intermediate layer panels 1160A and 1160B each comprise a generally imperforate or solid reinforcement region 1186 which is to underlie lacing 1016 of football 1010. In other implementations, panel 1160A and 1160B may alternatively comprise diamond or other polygonal-shaped depressions (craters) extending into one or both faces of panel 1160A and 1160B, wherein the depressions correspond in shape, size and location to the perforations 1184.

As shown by FIG. 27B, intermediate layer panel 1160B is identical to intermediate layer panel 1160A except that intermediate layer panel 1160B omits reinforcement region 1186. When intermediate layer panel 1160A is positioned beneath cover panels 1024 and 1030 and intermediate layer panel 1160B is positioned beneath cover panels 1026 and 1028, the four intermediate layer panels 1160A and 1160B collectively form intermediate layer 1160. In one example where the intermediate layer panel 1160 has a thickness of 0.435 inches, the intermediate layer panel 1160 has a mass reduction of 12.5 g, based upon a 39 g the intermediate layer panel without perforations. The illustrated perforations 1184 result in a total reduction of 1.9 ounces spread across or over the four intermediate layer panels 1160A and 1160B.

Although the pattern of perforations 1184 does not result in a greater weight or mass reduction of the central region of the intermediate layer panels 1160A and 1160B compared to end regions of the intermediate layer panels 1160A and 1160B, the plurality of perforations 1184 do result in a significant weight reduction of the intermediate layer panels 1160A and 1160B overall, which also has the effect of reducing the MOI of the football 1010 with respect to the longitudinal axis 24.

Figure 27C:
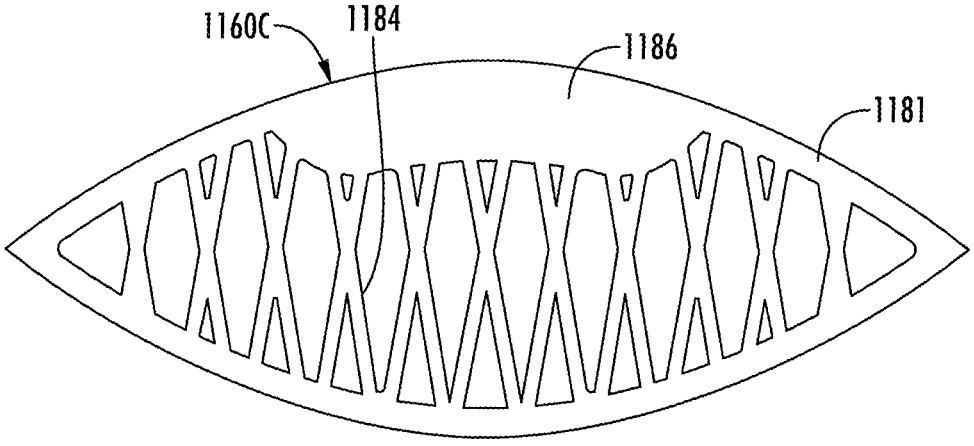
FIG. 27C is a plan view of an example third intermediate layer panel of the football of FIG. 22.

FIG. 27C illustrates another implementation of intermediate layer panel 1160C, which is positioned to correspond to, or lie beneath, cover panels 1024 and 1030. Intermediate layer panel 1160C includes the plurality of perforations 1184 extending along the entire surface of the intermediate layer panel 1160C such that intermediate layer panel 1160C does not include a center section, such as section 1188, without perforations. Accordingly, in one implementation, the intermediate layer panels 1160C can be positioned in the football 1010 to correspond with the cover panels 1024 and 1030 and be positioned away from the kicking region or kicking side of the football, while the back side or kicking side of the football 1010 can include the intermediate layer panel 1160B that includes the large center section 1188 for increasing the durability of the football at the kicking region or kicking side of the football. In such an embodiment, the intermediate layer panels 1160C positioned about the top side of the football 1010 adjacent or corresponding to cover panels 1024 and 1030 will have less mass than the intermediate layer panels 1160B positioned about the lower or kicking side of the football 1010 adjacent or corresponding to cover panels 1026 and 1028. Such an implementation can be used to further balance the football 1080 to compensate for the additional weight or mass provided by the lacing 16 to the top side or non-kicking side of the football 1010.

Figure 28A:
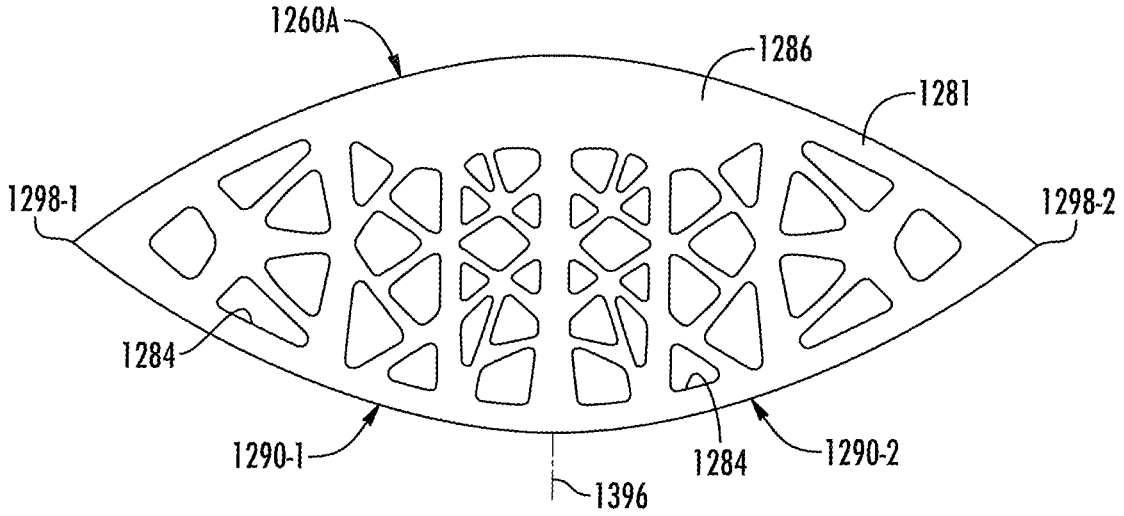
FIG. 28A is a plan view of an example first intermediate layer panel of the football of FIG. 22.
Figure 28B:
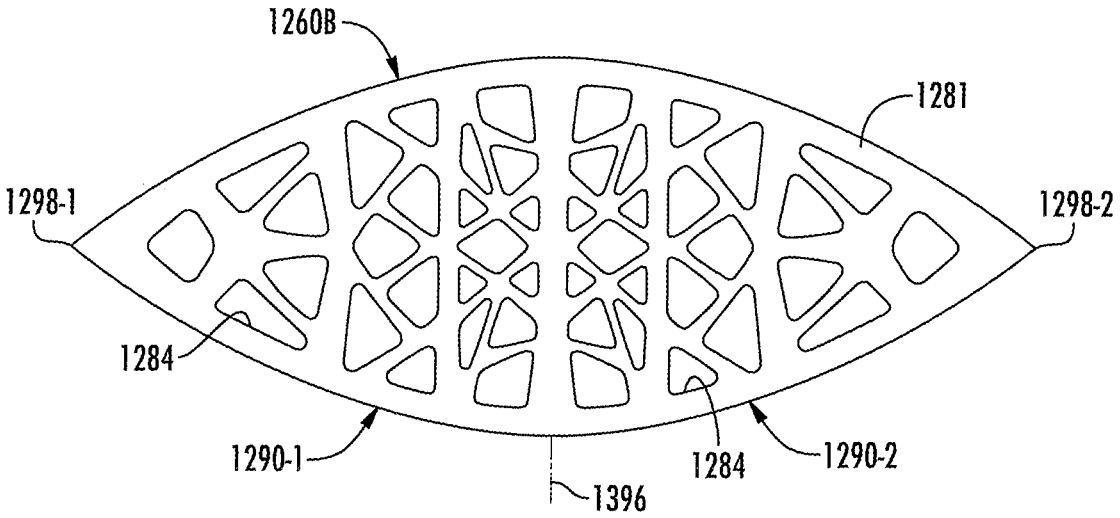
FIG. 28B is a plan view of an example second intermediate layer panel of the football of FIG. 22.

FIGS. 28A and 28B are plan views of another example pair of intermediate layer panels 1260A and 1260B for being positioned along cover panels 1024, 1030 and cover panels 1026, 1028, respectively. Panel 1260A is similar to panel 1060A except that panel 1260A has a different arrangement of perforations 1284.

In the example illustrated, each of the intermediate layer panels 1260A and 1260B comprise an outer frame 1281 extending about a pair of patterns 1290-1, 1290-2 of perforations 1284 that mirror one another as they extend from a mid-point or center point 1296 towards respective endpoints 1298-1 and 1298-2, which are located at the different or opposite noses of the assembled football 1010. In other implementations, intermediate layer panels 1260A and 1260B may alternatively comprise depressions (craters), having floors, extending into one or both faces of intermediate layer panel 1260A and 1260B, wherein the depressions correspond in shape, size and location to the perforations 1284. Referring to FIG. 28A, intermediate layer panel 1260A further includes reinforcement region 1286. Intermediate layer panel 1260A increases the amount of weight removed from a center region of the intermediate layer panel while maintaining struts to maintain the structural integrity of the intermediate layer panel 1260A and the football 1010, and inhibit stretching of the intermediate layer panel.

As shown by FIG. 28B, intermediate layer panel 1260B is identical to intermediate layer panel 1260A except that intermediate layer panel 1260B omits reinforcement region 1286. When intermediate layer panel 1260A is positioned beneath cover panels 1024 and 1030 and intermediate layer panel 1260B is positioned beneath cover panels 1026 and 1028, the four intermediate layer panels collectively form intermediate layer 1260. In one example where the intermediate layer panel 1260 has a thickness of 0.435 inches, the intermediate layer panel 1260 has a mass reduction of 13 g, based upon a 39 g the intermediate layer panel without perforations. The illustrated perforations 1284 result in a total reduction of 1.9 ounces spread across or over the four intermediate layer panels 1260A, 1260B.

Figure 29A:
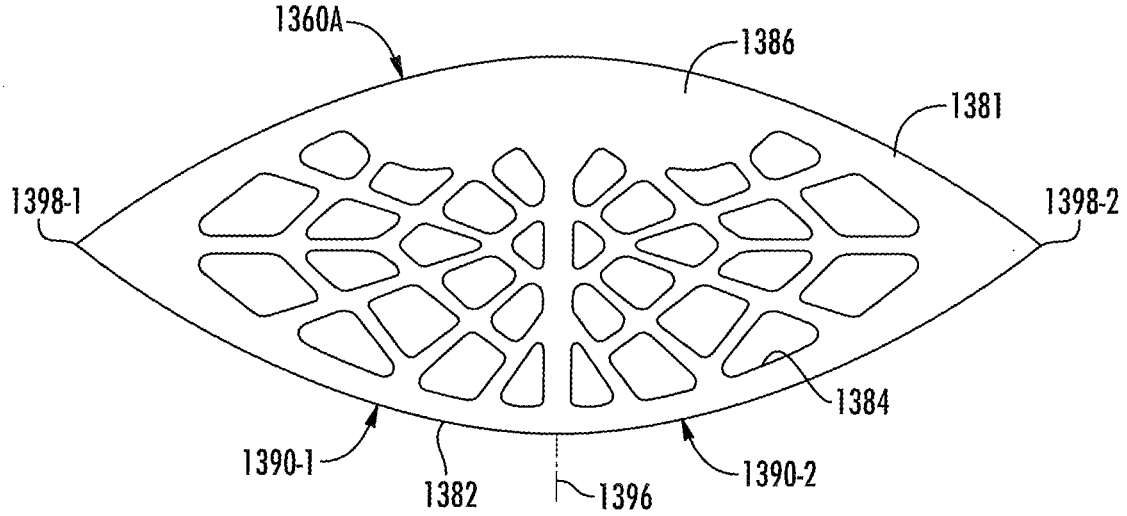
FIG. 29A is a plan view of an example first intermediate layer panel of the football of FIG. 22.
Figure 29B:
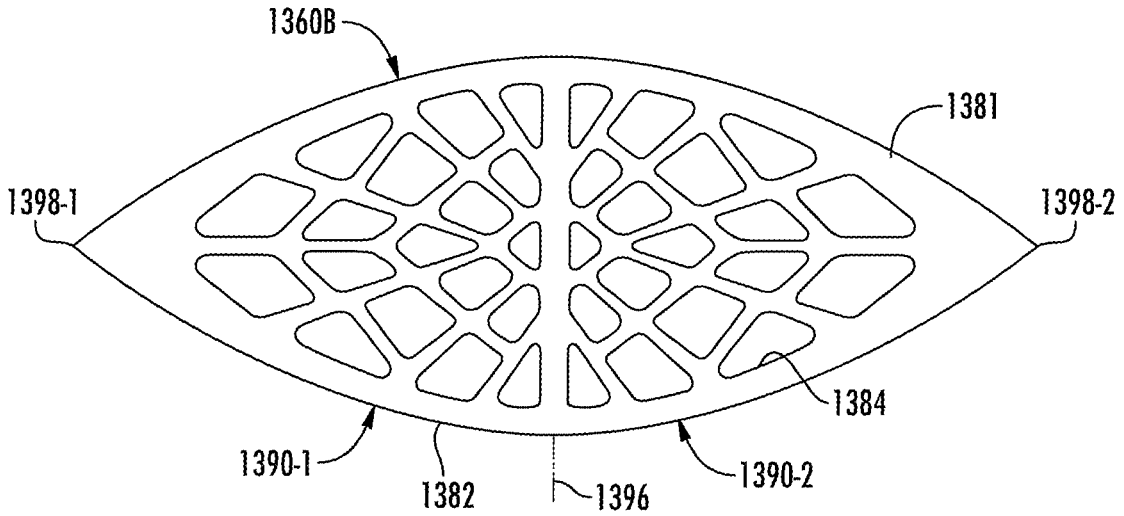
FIG. 29B is a plan view of an example second intermediate layer panel of the football of FIG. 22.

FIGS. 29A and 29B are plan views of another example pair of intermediate layer panels 1360A and 1360B for being positioned along cover panels 1024, 1030 and cover panels 1026, 1028, respectively. Panel 1360A is similar to panel 1060A except that panel 1360A has a different arrangement of perforations 1384.

In the example illustrated, each of the intermediate layer panels 1360A and 1360B comprise an outer frame 1381 extending about a pair of patterns 1390-1, 1390-2 of perforations 1384 that mirror one another as they extend from a mid-point or center point 1396 towards respective endpoints 1398-1 and 1398-2, which are located at the different or opposite noses of the assembled football 1010. In other implementations, intermediate layer panels 1360A and 1360B may alternatively comprise depressions (craters), having floors, extending into one or both faces of intermediate layer panel 1360A and 1360B, wherein the depressions correspond in shape, size and location to the perforations 1384. Referring to FIG. 29A, intermediate layer panel 1360A further includes reinforcement region 1386. Intermediate layer panel 1360A increases the amount of weight removed from a center region of the intermediate layer panel while maintaining struts to maintain the structural integrity of the intermediate layer panel 1360A and the football 1010, and inhibit stretching of the intermediate layer panel.

As shown by FIG. 29B, intermediate layer panel 1360B is identical to intermediate layer panel 1360A except that intermediate layer panel 1360B omits reinforcement region 1386. When intermediate layer panel 1360A is positioned beneath cover panels 1024 and 1030 and intermediate layer panel 1360B is positioned beneath cover panels 1026 and 1028, the four intermediate layer panels collectively form intermediate layer 1360. In one example where the intermediate layer panel 1380 has a thickness of 0.435 inches, the intermediate layer panel 1360 has a mass reduction of 14 g, based upon a 39 g the intermediate layer panel without perforations. The illustrated perforations 1384 result in a total reduction of 2.05 ounces spread across or over the four intermediate layer panels 1360A, 1360B.

Figure 30A:
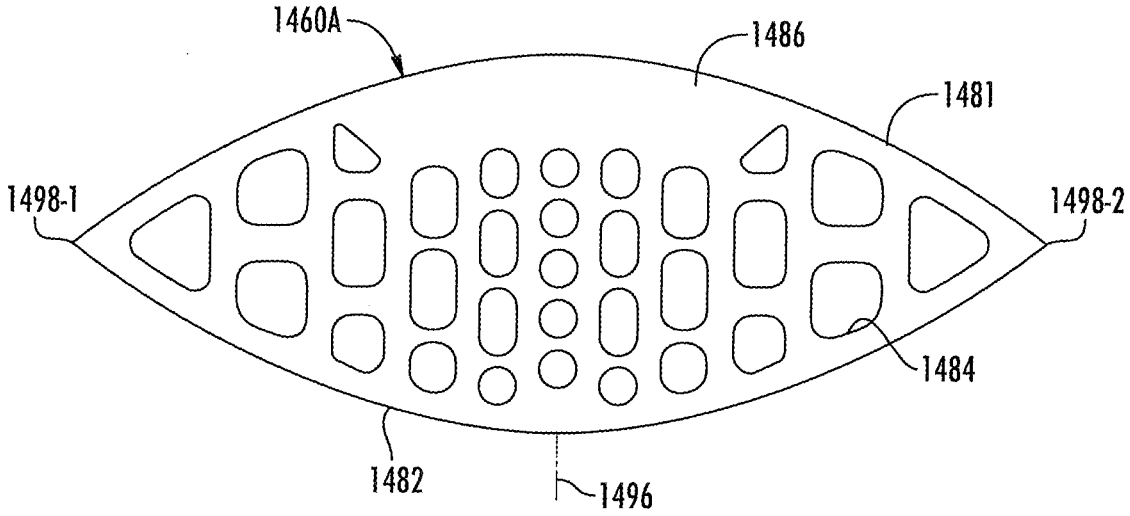
FIG. 30A is a plan view of an example first intermediate layer panel of the football of FIG. 22.
Figure 30B:
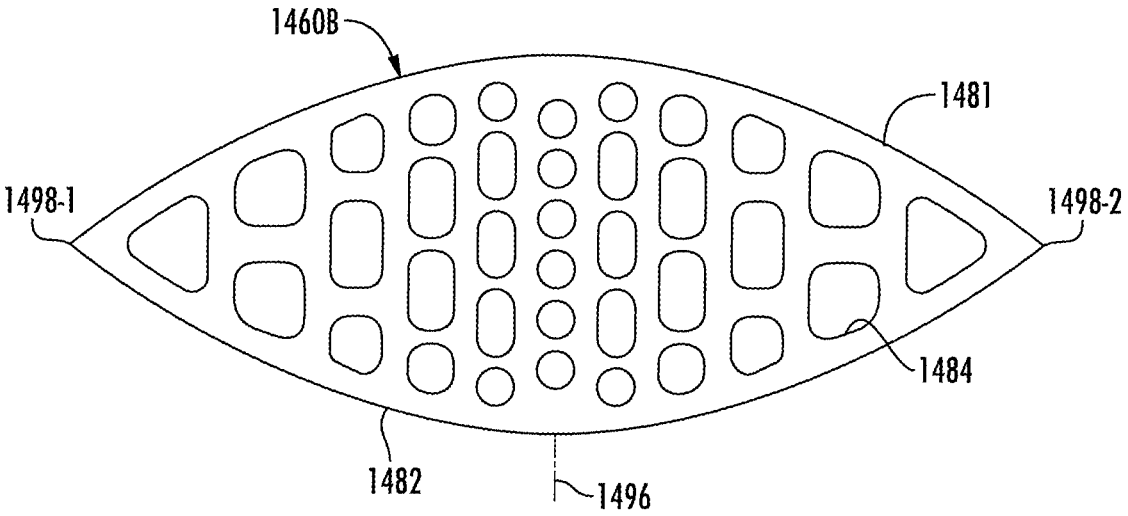
FIG. 30B is a plan view of an example second intermediate layer panel of the football of FIG. 22.

FIGS. 30A and 30B are plan views of another example pair of intermediate layer panels 1460A and 1460B for being positioned along cover panels 1024, 1030 and cover panels 1026, 1028, respectively. Panel 1460A is similar to panel 1060A except that panel 1460A has a different arrangement of perforations 1484.

In the example illustrated, each of the intermediate layer panels 1460A and 1460B comprise an outer frame 1481 extending about a pair of patterns 1490-1, 1490-2 of perforations 1484 that mirror one another as they extend from a mid-point or center point 1396 towards respective endpoints 1498-1 and 1498-2, which are located at the different or opposite noses of the assembled football 1010. In other implementations, intermediate layer panels 1460A and 1460B may alternatively comprise depressions (craters), having floors, extending into one or both faces of intermediate layer panel 1460A and 1460B, wherein the depressions correspond in shape, size and location to the perforations 1484. Referring to FIG. 30A, intermediate layer panel 1460A further includes reinforcement region 1486. Intermediate layer panel 1460A increases the amount of weight removed from a center region of the intermediate layer panel while maintaining struts to maintain the structural integrity of the intermediate layer panel 1460A and the football 1010, and inhibit stretching of the intermediate layer panel.

As shown by FIG. 30B, intermediate layer panel 1460B is identical to intermediate layer panel 1460A except that intermediate layer panel 1360B omits reinforcement region 1486. When intermediate layer panel 1460A is positioned beneath cover panels 1024 and 1030 and intermediate layer panel 1460B is positioned beneath cover panels 1026 and 1028, the four intermediate layer panels collectively form intermediate layer 1460. In one example where intermediate layer panels 1480 has a thickness of 0.435 inches, intermediate layer panel 1480 has a mass reduction of 13 g, based upon a 39 g panel.

The plurality of perforations 1084, 1184, 1284, 1384 or 1484 can reduce the weight of the intermediate layer panel 1060A, 1160A, 1260A, 1360A, 1460A or 1060B, 1160B, 1260B, 1360B, 1460B by at least 10 percent. In other implementations, the plurality of the perforations 1084, 1184, 1284, 1384 or 1484 can reduce the weight of the intermediate layer panel 1060A, 1160A, 1260A, 1360A, 1460A or 1060B, 1160B, 1260B, 1360B, 1460B by at least 20 percent. In other implementations, the plurality of perforations 1084, 1184, 1284, 1384 or 1484 can result in a reduction in weight of the intermediate layer panel 1060A, 1160A, 1260A, 1360A, 1460A or 1060B, 1160B, 1260B, 1360B, 1460B within the range of 25 to 50 percent.

FIGS. 26A and 26B through 30A and 30B, illustrate example patterns of perforations 1084, 1184, 1284, 1384 or 1484. In other implementations, other patterns of perforations 1084, 1184, 1284, 1384 or 1484 can be used. In still other implementations, the perforations 1084, 1184, 1284, 1384 or 1484 can include other shapes, such as, for example, circular perforations, ovular perforations, square-shaped perforations, other rectangular-shaped perforations, triangular-shaped perforations, other polygonal-shaped perforations, irregularly-shaped perforations and combinations thereof.

In other implementations, the weight of each of the intermediate layer panels may be removed across the face of each of such panels in other fashions. For example, in other implementations, in addition to the illustrated perforations or without any perforations, intermediate layer panels 1060 may be foamed, encapsulating air pockets or cells, such as cells 270 described above (see FIG. 9A). In yet other implementations, the mass of such panels may be reduced by reducing the thickness of panels 1060 or by forming panels 1060 from a material composition that has a lower density or lower weight per unit volume.

Figure 24:
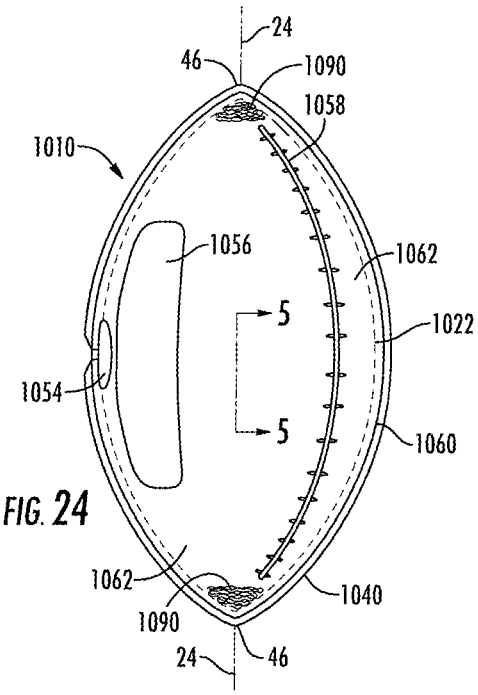
FIG. 24 is a side view of the football of FIG. 1 with outer layers of the football shown in section.

In one implementation, as shown by FIG. 24, the MOI of football may be further decreased by adding weight to football 1010 proximate to the longitudinal axis or longitudinal centerline 24. Because the weight of intermediate layer 1060 is reduced, additional weight may be added on, or proximate to, the longitudinal axis 24 while maintaining the total mass or weight of football 1010 within regulatory standards for the weight of footballs used in particular leagues such as high school associations, college associations (e.g., NCAA and FBS) or professional leagues (e.g., NFL). For example, as discussed above, panels 1060 reduce a mass of the layer 1060 by approximately 2.4 ounces. In such an implementation, one or more additional weights having a total weight up to 2.4 ounces may be added to the football 1010, while maintaining the overall mass or weight of the football 1010 as compared to similar footballs having a layer 1060 that does not include the perforations. In some implementations, the amount of weight that is added may exceed the amount of weight removed through the use of perforations or other layer voids to precisely define the weight of football 1010 at the limits of applicable regulatory weight range(s). In other implementations, the amount of weight added can be less than the amount of weight removed through the use of perforations or other layer voids to define the weight of the football 1010 within an applicable regulatory weight range(s).

As shown in broken lines in FIG. 24, in one implementation, a mass of material 1090 may be provided at each of the opposite noses 44, 46 of football 1010. In one implementation, the mass of material 1090 may be bonded to the interior of bladder 1022 or otherwise supported within bladder 1022 proximate to centerline 24.

Figure 24A:
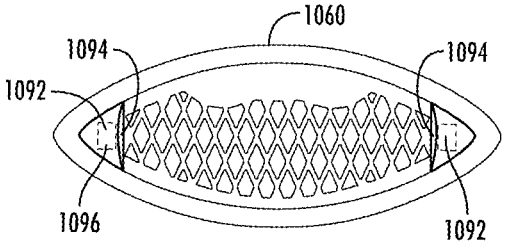
FIG. 24A is a plan view of an example intermediate layer panel of the football of FIG. 22.

As shown by FIG. 24A, in another implementation, one or more of the intermediate layer panels 1060 (or one or more of the cover panels 1024 through 1030) can include an extra flap or a pair of flaps 1092 forming a pocket 1094 at the opposite noses or ends of the intermediate layer panels 1060 (or one or more of the cover panels 1024 through 1030) near the ends 44 and 46 of football 1010. Each of the pockets 1094 can include a mass or weight plug 1096. The pocket may be sewn, glued or otherwise sealed to retain the weight 1096. The weight or plug 1096 may alternatively be retained within pocket 1094 with an adhesive or an encapsulating epoxy or other material. In one implementation, the mass of material may comprise a high-density material such as tungsten or barium sulfide. It should be appreciated that the above-described pockets and disclosed methods for retaining weights within such pockets may be equally and similarly applied to all of the intermediate layer panels and intermediate layers, or to the inner surface of one or more of the cover panels 1024 through 1030 described above throughout this disclosure.

Figure 24B:
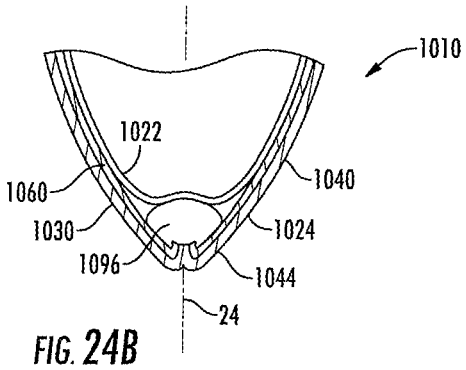
FIG. 24B is a sectional side view of the football of FIG. 22 with a weight positioned at the end of the football.

Referring to FIG. 24B, in another implementation, the mass or weight 1096 can be positioned within the football 1010 toward the ends or noses 44 and 46 of the football 1010 between the bladder 1022 and the intermediate layer 1060. The mass or weight can be formed of a material that bonds to the intermediate layer 1060. In other implementations, the mass or weight 1096 can be attached to the intermediate layer 1060 and/or to the outer surface of the bladder 1022 through an adhesive, an epoxy or other attachment means. It should be appreciated that the above-described application of a mass or weight to the football 1010 may be equally and similarly applied to the football between the intermediate layer panel 1060 and the outermost layer 1040 toward the ends 44 and 46 of the football 1010.

Although the present disclosure has been described with reference to example implementations, workers skilled in the art will recognize that changes may be made in form and detail without departing from the spirit and scope of the claimed subject matter. For example, although different example implementations may have been described as including features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. An American-style football comprising:

a prolate spheroidal shaped bladder having a longitudinal axis;

an outermost layer about the bladder;

a lacing surface featuring a series of parallel projections from an exterior of the outermost layer; and a non-uniform layer sandwiched between the bladder and the outermost layer, the non-uniform layer having non-uniform distribution of mass providing a greater mass proximate the longitudinal axis to decrease a MOI of the football, wherein the non-uniform layer has a first region distant the longitudinal axis having a first material composition having a first material density and a second region proximate the longitudinal axis having a second material composition, different than the first material composition and having a second material density greater than the first material density, wherein the second region is symmetric with respect to the longitudinal axis.

2. The American-style football of claim 1, wherein the first region distant the longitudinal axis has a first density of the first material and the second region proximate the longitudinal axis has a second density of a second material greater than the first density of the first material.

3. The American-style football of claim 2, wherein the first region has a first density of individual apertures of a size through the layer and wherein the second region has a second density of individual apertures of the size through the layer less than the first density of the apertures.

4. The American-style football claim 2, wherein the first region comprises individual apertures of a first size through the layer and wherein the second region comprise individual apertures of a second size, smaller than the first size, through the layer.

5. The American-style football of claim 2, wherein the first region has a first density of individual cells of a size through the layer and wherein the second region has a second density of individual cells of the size through the layer less than the first density of individual cells.

6. The American-style football of claim 2, wherein the first region comprises individual cells of a first size through the layer and wherein the second region comprise individual cells of a second size, smaller than the first size, through the layer.

7. The American-style football of claim 1, wherein the first region comprises foamed material and wherein the second region comprises solid material.

8. The American-style football of claim 1, wherein the first material composition has a first strength and wherein the second material composition has a second strength less than the first strength.

9. The American-style football of claim 1, wherein the first region distant the longitudinal axis has a first thickness and the second region proximate the longitudinal axis has a second thickness greater than the first thickness.

10. The American-style football of claim 1, wherein the non-uniform layer comprises a woven, knitted or felted fabric, wherein the first region comprises first fibers having a first individual fiber density or having a first density of fibers and wherein the second region comprises second fibers having a second individual fiber density greater than the first individual fiber density or having a second density of fibers greater than the first density of fibers.

11. The American-style football of claim 1, wherein the non-uniform layer forms a liner between the bladder and the outermost layer.

12. The American-style football of claim 1, wherein the lacing surface comprises a lace passing through the outermost layer and forming the projections.

13. The American-style football of claim 1, wherein the non-uniform layer has a first region proximate the lacing surface and a second region proximate the longitudinal axis, wherein the first region is different than the second region.

14. The American-style football of claim 13, wherein the first region has a first material thickness and wherein the second region has a second material thickness greater than the first material thickness.

15. The American-style football of claim 1, wherein the longitudinal axis intersects the second region.

16. The American-style football of claim 1, wherein the second region continuously extends around the longitudinal axis.

* * * * *